US009168740B2

(12) United States Patent
Xie et al.

(10) Patent No.: US 9,168,740 B2
(45) **Date of Patent: *Oct. 27, 2015**

(54) PRINTHEAD INCLUDING ACOUSTIC DAMPENING STRUCTURE

(71) Applicant: Eastman Kodak Company, Rochester, NY (US)

(72) Inventors: Yonglin Xie, Pittsford, NY (US); Qing Yang, Pittsford, NY (US); John A. Lebens, Rush, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 34 days.

This patent is subject to a terminal disclaimer.

(21) Appl. No.: 13/860,553

(22) Filed: Apr. 11, 2013

(65) Prior Publication Data

US 2014/0307035 A1 Oct. 16, 2014

(51) Int. Cl.

| | |
|---|---|
| ***B41J 2/17*** | (2006.01) |
| ***B41J 2/19*** | (2006.01) |
| ***B41J 2/175*** | (2006.01) |
| ***B41J 2/05*** | (2006.01) |
| ***B41J 2/14*** | (2006.01) |
| ***B41J 2/02*** | (2006.01) |
| ***B41J 2/055*** | (2006.01) |

(52) U.S. Cl.

CPC ..... *B41J 2/14008* (2013.01); *B41J 2/02* (2013.01); *B41J 2/055* (2013.01); *B41J 2002/14419* (2013.01)

(58) Field of Classification Search

USPC ..... 347/94, 10, 20, 22, 40, 65, 73–78, 347/82–85, 92–93

See application file for complete search history.

(56) References Cited

U.S. PATENT DOCUMENTS

| | | | | | |
|---|---|---|---|---|---|
| 3,373,437 | A | | 3/1968 | Sweet | |
| 3,560,641 | A | | 2/1971 | Taylor et al. | |
| 3,596,275 | A | | 7/1971 | Sweet | |
| 3,739,393 | A | | 6/1973 | Lyon et al. | |
| 3,877,036 | A | | 4/1975 | Loeffler et al. | |
| 3,878,519 | A | | 4/1975 | Eaton | |
| 4,124,853 | A | * | 11/1978 | Kattner et al. | 347/94 |
| 4,167,742 | A | * | 9/1979 | Head et al. | 347/75 |
| 4,215,354 | A | * | 7/1980 | Larsson | 347/94 |
| 4,220,958 | A | | 9/1980 | Crowley | |
| 4,424,521 | A | * | 1/1984 | Lewis et al. | 347/85 |
| 4,439,780 | A | * | 3/1984 | DeYoung et al. | 347/68 |
| 4,528,571 | A | * | 7/1985 | Sweet | 347/94 |
| 4,638,327 | A | * | 1/1987 | Sutera et al. | 347/94 |

(Continued)

FOREIGN PATENT DOCUMENTS

| | | | | |
|---|---|---|---|---|
| JP | 55071569 | A | * | 5/1980 |
| JP | 55100169 | A | * | 7/1980 |

(Continued)

*Primary Examiner* — Julian Huffman
*Assistant Examiner* — Leonard S Liang
(74) *Attorney, Agent, or Firm* — William R. Zimmerli

(57) ABSTRACT

A printhead includes a nozzle plate including a plurality of nozzles and a plurality of liquid chambers. Each liquid chamber is in fluid communication with a respective one of the plurality of nozzles. An acoustic dampening structure includes a plurality of sets of air pockets and liquid flow restrictors. Each liquid chamber is in fluid communication with one of the sets of air pockets and liquid flow restrictors. A common liquid supply manifold is in fluid communication with each liquid chamber through the liquid flow restrictor associated with the liquid chamber.

15 Claims, 21 Drawing Sheets

(56) References Cited

U.S. PATENT DOCUMENTS

| | | | | |
|---|---|---|---|---|
| 4,638,328 | A | 1/1987 | Drake et al. | |
| 5,224,843 | A | 7/1993 | Van Lintel | |
| 5,841,452 | A * | 11/1998 | Silverbrook | 347/47 |
| 6,250,752 | B1 * | 6/2001 | Tajima et al. | 347/92 |
| 6,290,331 | B1 * | 9/2001 | Agarwal et al. | 347/47 |
| 6,309,042 | B1 * | 10/2001 | Veregin et al. | 347/21 |
| 6,387,225 | B1 | 5/2002 | Shimada et al. | |
| 6,450,628 | B1 * | 9/2002 | Jeanmaire et al. | 347/75 |
| 6,474,784 | B1 | 11/2002 | Fujii et al. | |
| 6,505,921 | B2 | 1/2003 | Chwalek et al. | |
| 6,511,161 | B2 | 1/2003 | Sumi et al. | |
| 6,535,460 | B2 * | 3/2003 | Loeppert et al. | 367/181 |
| 6,543,107 | B1 | 4/2003 | Miyashita et al. | |
| 6,561,627 | B2 | 5/2003 | Jarrold et al. | |
| 6,561,631 | B2 * | 5/2003 | Shin et al. | 347/65 |
| 6,588,888 | B2 | 7/2003 | Jeanmaire et al. | |
| 7,229,159 | B2 * | 6/2007 | Chikamoto et al. | 347/65 |
| 7,354,132 | B2 * | 4/2008 | Suzuki | 347/23 |
| 7,938,516 | B2 | 5/2011 | Piatt et al. | |
| 2002/0175976 | A1 * | 11/2002 | Okuda | 347/71 |
| 2003/0001936 | A1 | 1/2003 | Hirosawa et al. | |
| 2004/0036751 | A1 * | 2/2004 | Giere et al. | 347/93 |
| 2007/0064037 | A1 * | 3/2007 | Hawkins et al. | 347/19 |
| 2007/0064066 | A1 * | 3/2007 | Piatt et al. | 347/74 |
| 2007/0064068 | A1 * | 3/2007 | Piatt et al. | 347/75 |
| 2007/0103519 | A1 * | 5/2007 | Takahashi et al. | 347/85 |
| 2007/0109373 | A1 * | 5/2007 | Kojima | 347/94 |
| 2008/0088680 | A1 * | 4/2008 | Xu et al. | 347/75 |
| 2008/0143766 | A1 * | 6/2008 | Hawkins et al. | 347/11 |
| 2009/0102907 | A1 * | 4/2009 | Yamanaka et al. | 347/94 |
| 2010/0033542 | A1 * | 2/2010 | Piatt et al. | 347/75 |
| 2010/0033543 | A1 * | 2/2010 | Piatt et al. | 347/77 |
| 2012/0300000 | A1 | 11/2012 | Panchawagh et al. | |
| 2013/0147887 | A1 * | 6/2013 | Kimura et al. | 347/93 |
| 2013/0241986 | A1 * | 9/2013 | AOKI et al. | 347/10 |

FOREIGN PATENT DOCUMENTS

| | | |
|---|---|---|
| JP | 59098859 | 6/1984 |
| JP | 06191030 | 7/1994 |

* cited by examiner

PRINTHEAD INCLUDING ACOUSTIC DAMPENING STRUCTURE

CROSS REFERENCE TO RELATED APPLICATIONS

Reference is made to commonly-assigned, U.S. patent application Ser. No. 13/860,554, entitled "PRINTHEAD INCLUDING ACOUSTIC DAMPENING STRUCTURE", filed concurrently herewith.

FIELD OF THE INVENTION

This invention relates generally to the field of digitally controlled printing and liquid patterning devices, and in particular to continuous ink jet systems in which a liquid stream breaks into drops, some of which are selectively deflected.

BACKGROUND OF THE INVENTION

Ink jet printing has become recognized as a prominent contender in the digitally controlled, electronic printing arena because of its non-impact, low-noise characteristics, its use of plain paper and its avoidance of toner transfer and fixing. Ink jet printing mechanisms can be categorized by technology as either drop-on-demand ink jet or continuous ink jet.

The first technology, "drop-on-demand" ink jet printing, provides ink droplets that impact upon a recording surface by using a pressurization actuator (thermal, piezoelectric, etc.). Many commonly practiced drop-on-demand technologies use thermal actuation to eject ink droplets from a nozzle. A heater, located at or near the nozzle, heats the ink sufficiently to boil, forming a vapor bubble that creates enough internal pressure to eject an ink droplet. This form of ink jet is commonly termed "thermal ink jet (TIJ)." Other known drop-on-demand droplet ejection mechanisms include piezoelectric actuators, such as that disclosed in U.S. Pat. No. 5,224,843, issued to van Lintel, on Jul. 6, 1993; thermomechanical actuators, such as those disclosed by Jarrold et al., U.S. Pat. No. 6,561,627, issued May 13, 2003; and electrostatic actuators, as described by Fujii et al., U.S. Pat. No. 6,474,784, issued Nov. 5, 2002.

The second technology, commonly referred to as "continuous" ink jet printing, uses a pressurized ink source that produces a continuous stream of ink droplets from a nozzle. The stream is perturbed in some fashion causing it to break up into substantially uniform sized drops at a nominally constant distance, the break-off length, from the nozzle. A charging electrode structure is positioned at the nominally constant break-off point so as to induce a data-dependent amount of electrical charge on the drop at the moment of break-off. The charged droplets are directed through a fixed electrostatic field region causing each droplet to deflect proportionately to its charge. The charge levels established at the break-off point thereby cause drops to travel to a specific location on a recording medium or to a gutter for collection and recirculation.

Continuous ink jet (CIJ) drop generators rely on the physics of an unconstrained fluid jet, first analyzed in two dimensions by F. R. S. (Lord) Rayleigh, "Instability of jets," Proc. London Math. Soc. 10 (4), published in 1878. Lord Rayleigh's analysis showed that liquid under pressure, P, will stream out of a hole, the nozzle, forming a jet of diameter, $d_j$, moving at a velocity, $v_j$. The jet diameter, $d_j$, is approximately equal to the effective nozzle diameter, $D_{dn}$, and the jet velocity is proportional to the square root of the reservoir pressure, P. Rayleigh's analysis showed that the jet will naturally break up into drops of varying sizes based on surface waves that have wavelengths, $\lambda$, longer than $\pi d_j$, i.e. $\lambda \geq \pi d_j$. Rayleigh's analysis also showed that particular surface wavelengths would become dominate if initiated at a large enough magnitude, thereby "synchronizing" the jet to produce mono-sized drops. Continuous ink jet (CIJ) drop generators employ some periodic physical process, a so-called "perturbation" or "stimulation", that has the effect of establishing a particular, dominant surface wave on the jet. The surface wave grows causing the break-off of the jet into mono-sized drops synchronized to the frequency of the perturbation.

The drop stream that results from applying Rayleigh stimulation will be referred to herein as a stream of drops of predetermined volume as distinguished from the naturally occurring stream of drops of widely varying volume. While in prior art CIJ systems, the drops of interest for printing or patterned layer deposition were invariably of substantially unitary volume, it will be explained that for the present inventions, the stimulation signal may be manipulated to produce drops of predetermined substantial multiples of the unitary volume. Hence the phrase, "streams of drops of predetermined volumes" is inclusive of drop streams that are broken up into drops all having nominally one size or streams broken up into drops of selected (predetermined) different volumes.

In a CIJ system, some drops, usually termed "satellites" much smaller in volume than the predetermined unit volume, may be formed as the stream necks down into a fine ligament of fluid. Such satellites may not be totally predictable or may not always merge with another drop in a predictable fashion, thereby slightly altering the volume of drops intended for printing or patterning. The presence of small, unpredictable satellite drops is, however, inconsequential to the present invention and is not considered to obviate the fact that the drop sizes have been predetermined by the synchronizing energy signals used in the present inventions. Thus the phrase "predetermined volume" as used to describe the present inventions should be understood to comprehend that some small variation in drop volume about a planned target value may occur due to unpredictable satellite drop formation.

Many commercially practiced CIJ printheads use a piezoelectric device, acoustically coupled to the printhead, to initiate a dominant surface wave on the jet. The coupled piezoelectric device superimposes periodic pressure variations on the base reservoir pressure, causing velocity or flow perturbations that in turn launch synchronizing surface waves. A pioneering disclosure of a piezoelectrically-stimulated CIJ apparatus was made by R. Sweet in U.S. Pat. No. 3,596,275, issued Jul. 27, 1971, Sweet '275 hereinafter. The CIJ apparatus disclosed by Sweet '275 consisted of a single jet, i.e. a single drop generation liquid chamber and a single nozzle structure.

Sweet '275 disclosed several approaches to providing the needed periodic perturbation to the jet to synchronize drop break-off to the perturbation frequency. Sweet '275 discloses a magnetostrictive material affixed to a capillary nozzle enclosed by an electrical coil that is electrically driven at the desired drop generation frequency, vibrating the nozzle, thereby introducing a dominant surface wave perturbation to the jet via the jet velocity. Sweet '275 also discloses a thin ring-electrode positioned to surround but not touch the unbroken fluid jet, just downstream of the nozzle. If the jetted fluid is conductive, and a periodic electric field is applied between the fluid filament and the ring-electrode, the fluid jet may be caused to expand periodically, thereby directly introducing a surface wave perturbation that can synchronize the jet break-off. This CIJ technique is commonly called electrohydrodynamic (EHD) stimulation.

Sweet '275 further disclosed several techniques for applying a synchronizing perturbation by superimposing a pressure variation on the base liquid reservoir pressure that forms the jet. Sweet '275 disclosed a pressurized fluid chamber, the drop generator chamber, having a wall that can be vibrated mechanically at the desired stimulation frequency. Mechanical vibration means disclosed included use of magnetostrictive or piezoelectric transducer drivers or an electromagnetic moving coil. Such mechanical vibration methods are often termed "acoustic stimulation" in the CIJ literature.

The several CIJ stimulation approaches disclosed by Sweet '275 may all be practical in the context of a single jet system. However, the selection of a practical stimulation mechanism for a CIJ system having many jets is far more complex. A pioneering disclosure of a multi-jet CIJ printhead has been made by Sweet et al. in U.S. Pat. No. 3,373,437, issued Mar. 12, 1968, Sweet '437 hereinafter. Sweet '437 discloses a CIJ printhead having a common drop generator chamber that communicates with a row (an array) of drop emitting nozzles. A rear wall of the common drop generator chamber is vibrated by means of a magnetostrictive device, thereby modulating the chamber pressure and causing a jet velocity perturbation on every jet of the array of jets.

Since the pioneering CIJ disclosures of Sweet '275 and Sweet '437, most disclosed multi jet CIJ printheads have employed some variation of the jet break-off perturbation means described therein. For example, U.S. Pat. No. 3,560,641 issued Feb. 2, 1971 to Taylor et al. discloses a CIJ printing apparatus having multiple, multi jet arrays wherein the drop break-off stimulation is introduced by means of a vibration device affixed to a high pressure ink supply line that supplies the multiple CU printheads. U.S. Pat. No. 3,739,393 issued Jun. 12, 1973 to Lyon et al. discloses a multi-jet CIJ array wherein the multiple nozzles are formed as orifices in a single thin nozzle plate and the drop break-off perturbation is provided by vibrating the nozzle plate, an approach akin to the single nozzle vibrator disclosed by Sweet '275. U.S. Pat. No. 3,877,036 issued Apr. 8, 1975 to Loeffler et al. discloses a multi-jet CIJ printhead wherein a piezoelectric transducer is bonded to an internal wall of a common drop generator chamber, a combination of the stimulation concepts disclosed by Sweet '437 and '275

Unfortunately, stimulation devices and techniques employing a vibration of some component of the printhead structure or a modulation of the common supply pressure result in some amount of non-uniformity of the magnitude of the perturbation applied to each individual jet of a multi jet CIJ array. Non-uniform stimulation leads to a variability in the break-off length and timing among the jets of the array. This variability in break-off characteristics, in turn, leads to an inability to position a common drop charging assembly or to use a data timing scheme that can serve all of the jets of the array.

In addition to addressing problems of break-off time control among jets of an array, continuous drop emission systems that generate drops in which at least one of the predetermined volume, the drop velocity, breakoff length, or the drop break off phase are based on the liquid-deposition pattern data, commonly called print data, need a means of stimulating each individual jet in an independent fashion in response to the print data. Consequently, in recent years an effort has been made to develop practical "stimulation per jet" apparatus capable of applying individual stimulation signals to individual jets. As will be discussed herein, plural stimulation element apparatus have been successfully developed; however, some inter jet stimulation "crosstalk" problems may remain.

The electrohydrodynamic (EHD) jet stimulation concept disclosed by Sweet '275 operates on the emitted liquid jet filament directly, causing minimal acoustic excitation of the printhead structure itself, thereby avoiding the above noted confounding contributions of printhead and mounting structure resonances. U.S. Pat. No. 4,220,958 issued Sep. 2, 1980 to Crowley discloses a CIJ printer wherein the perturbation is accomplished by an EHD exciter composed of pump electrodes of a length equal to about one-half the droplet spacing. The multiple pump electrodes are spaced at intervals of multiples of about one-half the droplet spacing or wavelength downstream from the nozzles. This arrangement greatly reduces the voltage needed to achieve drop break-off over the configuration disclosed by Sweet '275.

While EHD stimulation has been pursued as an alternative to acoustic stimulation, it has not been applied commercially because of the difficulty in fabricating printhead structures having the very close jet-to-electrode spacing and alignment required and, then, operating reliably without electrostatic breakdown occurring. Also, due to the relatively long range of electric field effects, EHD is not amenable to providing individual stimulation signals to individual jets in an array of closely spaced jets.

An alternate jet perturbation concept that overcomes all of the drawbacks of acoustic or EHD stimulation was disclosed for a single jet CIJ system in U.S. Pat. No. 3,878,519 issued Apr. 15, 1975 to J. Eaton. Eaton discloses the thermal stimulation of a jet fluid filament by means of localized light energy or by means of a resistive heater located at the nozzle, the point of formation of the fluid jet. Eaton explains that the fluid properties, especially the surface tension, of a heated portion of a jet may be sufficiently changed with respect to an unheated portion to cause a localized change in the diameter of the jet, thereby launching a dominant surface wave if applied at an appropriate frequency. U.S. Pat. No. 4,638,328 issued Jan. 20, 1987 to Drake, et al. discloses a thermally-stimulated multi-jet CIJ drop generator fabricated in an analogous fashion to a thermal ink jet device. That is, Drake discloses the operation of a traditional thermal ink jet (TIJ) edgeshooter or roofshooter device in CIJ mode by supplying high pressure ink and applying energy pulses to the heaters sufficient to cause synchronized break-off but not so as to generate vapor bubbles.

Also recently, microelectromechanical systems (MEMS), have been disclosed that utilize electromechanical and thermomechanical transducers to generate mechanical energy for performing work. For example, thin film piezoelectric, ferroelectric or electrostrictive materials such as lead zirconate titanate (PZT), lead lanthanum zirconate titanate (PLZT), or lead magnesium niobate titanate (PMNT) may be deposited by sputtering or sol gel techniques to serve as a layer that will expand or contract in response to an applied electric field. See, for example Shimada, et al. in U.S. Pat. No. 6,387,225, issued May 14, 2002; Sumi, et al., in U.S. Pat. No. 6,511,161, issued Jan. 28, 2003; and Miyashita, et al., in U.S. Pat. No. 6,543,107, issued Apr. 8, 2003. Thermomechanical devices utilizing electroresistive materials that have large coefficients of thermal expansion, such as titanium aluminide, have been disclosed as thermal actuators constructed on semiconductor substrates. See, for example, Jarrold et al., U.S. Pat. No. 6,561,627, issued May 13, 2003. Therefore electromechanical devices may also be configured and fabricated using microelectronic processes to provide stimulation energy on a jet-by-jet basis.

U.S. Pat. No. 6,505,921 issued to Chwalek, et al. on Jan. 14, 2003, discloses a method and apparatus whereby a plurality of thermally deflected liquid streams is caused to break up into drops of large and small volumes, hence, large and small cross-sectional areas. Thermal deflection is used to cause smaller drops to be directed out of the plane of the plurality of streams of drops while large drops are allowed to fly along nominal "straight" pathways. In addition, a uniform gas flow is imposed in a direction having velocity components perpendicular and across the array of streams of drops of cross-sectional areas. The perpendicular gas flow velocity components apply more force per mass to drops having smaller cross-sections than to drops having larger cross-sections, resulting in an amplification of the deflection acceleration of the small drops.

U.S. Published Application No. 20100033542 by Piatt et al., Feb. 11, 2010, discloses a method and apparatus whereby a plurality of liquid streams are caused to breakoff at longer or shorter breakoff lengths in response to the print data, and thereby cause the drops that break off to break off in regions of higher or lower electric field strengths. This yields drops of higher or lower drop charge to be formed. The subsequent deflection of these drops by an electric field causes the trajectories of the higher and lower charge to diverge. A catcher is positioned to intercept the trajectory of one of the higher and lower charged drops while drops travelling along the other trajectory are allowed to strike the print media.

U.S. Pat. No. 7,938,516, issued to Piatt, et al. published on May 10, 2011, discloses a method and apparatus whereby the breakoff phase of drops from a plurality of liquid streams are varied in response to print data, such that certain drops break off while a charge electrode is at a first voltage, and the other drops break off while the charge electrode is at a second voltage. As a result the drops breaking off are charged and subsequently deflected by different amount according to the voltage on the charge electrode at the time of breakoff. A catcher is positioned to intercept the trajectory of the drops charged by one of the first or the second charge plate voltage while drops travelling along the other trajectory are allowed to strike the print media.

U.S. Published Application No. 20120300000 by Panchawagh, published on Nov. 29, 2012, discloses an apparatus in which a series pairs of drops are created; one drop of each drop pair breaks off while the charge plate is at a first voltage and the other breaks off while the charge plate is at a second voltage. In response to print data, the relative velocity of the drops in the drop pair can be modulated so that the drops of certain drop pairs merge to form a drop having the combined mass and charge of the individual drops. The drops in the other drop pairs do not merge. The merged and unmerged drops pairs pass through an electric field that causes the merged drops to strike the catcher along with one of the drops of the non-merged drop pairs, while the other drop of the non-merged drop pair is allowed to strike the print media.

Continuous drop emission systems that utilize stimulation per jet apparatus are effective in providing control of the break-up parameters of an individual jet within a large array of jets. The inventors of the present inventions have found, however, that even when the stimulation is highly localized to each jet, for example, via resistive heating at the nozzle exit of each jet, some stimulation crosstalk still propagates as acoustic energy through the liquid via the common supply chambers. The added acoustic stimulation crosstalk from adjacent jets may adversely affect jet break up in terms of breakoff timing, breakoff length, relative drop velocity, or satellite drop formation. When operating in a printing mode of generating different predetermined drop volumes, according to the print data, acoustic stimulation crosstalk may alter the jet break-up producing drops that are not the desired predetermined volume. Especially in the case of systems using multiple predetermined drop volumes, the effects of acoustic stimulation cross talk are data-dependent, leading to complex interactions that are difficult to predict.

Consequently, there is a need to improve the stimulation per jet type of continuous liquid drop emitter by reducing inter-jet acoustic stimulation crosstalk so that the break-up characteristics of individual jets are predictable, and may be relied upon in translating print data into drop generation pulse sequences for the plurality of jets in a large array of continuous drop emitters.

SUMMARY OF THE INVENTION

According to one aspect of the invention, a printhead includes a nozzle plate including a plurality of nozzles and a plurality of liquid chambers. Each liquid chamber is in fluid communication with a respective one of the plurality of nozzles. An acoustic dampening structure includes a plurality of sets of air pockets and liquid flow restrictors. Each liquid chamber is in fluid communication with one of the sets of air pockets and liquid flow restrictors. A common liquid supply manifold is in fluid communication with each liquid chamber through the liquid flow restrictor associated with the liquid chamber.

BRIEF DESCRIPTION OF THE DRAWINGS

In the detailed description of the example embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
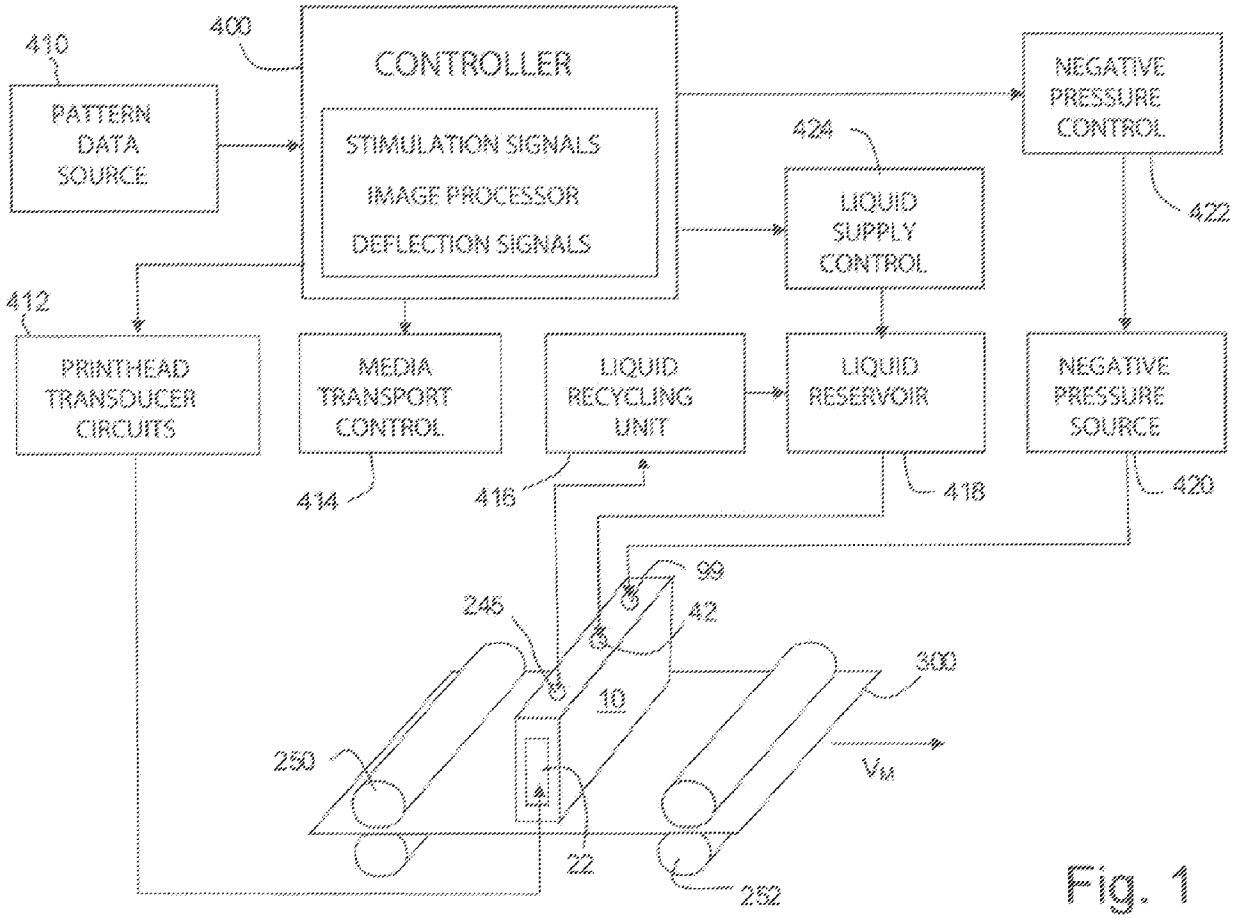
FIG. 1 shows a simplified block schematic diagram of one exemplary liquid pattern deposition apparatus made in accordance with the present invention.

Referring to FIG. 1, a continuous drop emission system for depositing a liquid pattern is illustrated. Typically such systems are ink jet printers and the liquid pattern is an image printed on a receiver sheet or web. However, other liquid patterns can be deposited by the system illustrated including, for example, masking and chemical initiator layers for manufacturing processes. For the purposes of understanding the present inventions the terms "liquid" and "ink" will be used interchangeably, recognizing that inks are typically associated with image printing, a subset of the potential applications of the present inventions. The liquid pattern deposition system is controlled by a process controller 400 that interfaces with various input and output components, computes necessary translations of data and executes needed programs and algorithms.

The liquid pattern deposition system further includes a source of the image or print data 410 which provides raster image data, outline image data in the form of a page description language, or other forms of digital image data. This image data is converted to bitmap image data by controller 400 and stored for transfer to a multi-jet drop emission printhead 10 via a plurality of printhead transducer circuits 412 connected to printhead electrical interface 20. The bit map image data specifies the deposition of individual drops onto the picture elements (pixels) of a two dimensional matrix of positions, equally spaced a pattern raster distance, determined by the desired pattern resolution, i.e. the pattern "dots per inch" or the like. The raster distance or spacing can be equal or can be different in the two dimensions of the pattern.

Controller 400 also creates drop synchronization signals to the printhead transducer circuits that are subsequently applied to printhead 10 to cause the break-up of the plurality of fluid streams emitted into drops of predetermined volume and with a predictable timing. Printhead 10 is illustrated as a "page wide" printhead in that it contains a plurality of jets sufficient to print all scanlines across the medium 300 without need for movement of the printhead itself.

Recording medium 300 is moved relative to printhead 10 by a recording medium transport system, which is electronically controlled by a media transport control system 414, and which in turn is controlled by controller 400. The recording medium transport system shown in FIG. 1 is a schematic representation only; many different mechanical configurations are possible. For example, input transfer roller 250 and output transfer roller 252 could be used in a recording medium transport system to facilitate transfer of the liquid drops to recording medium 300. Such transfer roller technology is well known in the art. In the case of page width printheads as illustrated in FIG. 1, it is most convenient to move recording medium 300 past a stationary printhead. Recording medium 300 is transported at a velocity, $V_M$. In the case of scanning print systems, it is usually most convenient to move the printhead along one axis (the sub-scanning direction) and the recording medium along an orthogonal axis (the main scanning direction) in a relative raster motion. The present inventions are equally applicable to printing systems having moving or stationary printheads and moving or stationary receiving media, and all combinations thereof.

Pattern liquid is contained in a liquid reservoir 418 under pressure. In the non-printing state, continuous drop streams are unable to reach recording medium 300 due to a fluid gutter (not shown) that captures the stream and which can allow a portion of the liquid to be recycled by a liquid recycling unit 416. The liquid recycling unit 416 receives the un-printed liquid via printhead fluid outlet 245, reconditions the liquid and feeds it back to reservoir 418 or stores it. The liquid recycling unit can also be configured to apply a vacuum pressure to printhead fluid outlet 245 to assist in liquid recovery and to affect the gas flow through printhead 10. Such liquid recycling units are well known in the art. The liquid pressure suitable for optimal operation will depend on a number of factors, including geometry and thermal properties of the nozzles and thermal properties of the liquid. A constant liquid pressure can be achieved by applying pressure to liquid reservoir 418 under the control of liquid supply controller 424 that is managed by controller 400.

The liquid is distributed via a liquid supply line entering printhead 10 at liquid inlet port 42. The liquid preferably flows through slots and/or holes etched through a silicon substrate of printhead 10 to its front surface, where a plurality of nozzles and printhead transducers are situated. In some preferred embodiments of the present inventions the printhead transducers are resistive heaters. In other embodiments, more than one transducer per jet can be provided including some combination of resistive heaters, electric field electrodes and microelectromechanical flow valves. When printhead 10 is at least partially fabricated from silicon, it is possible to integrate some portion of the printhead transducer control circuits 412 with the printhead, simplifying printhead electrical connector 22.

A secondary drop deflection apparatus, described in more detail below, can be configured downstream of the liquid drop emission nozzles. This secondary drop deflection apparatus comprises an airflow plenum that generates air flows that impinge individual drops in the plurality of streams of drops flying along predetermined paths based on pattern data. A negative pressure source 420, controlled by the controller 400 through a negative pressure control apparatus 422, is connected to printhead 10 via negative pressure source inlet 99.

Figure 2A:
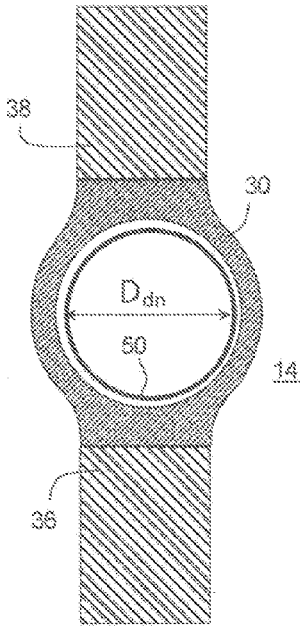
FIGS. 2*a* and 2*b* show schematic plan views of a single thermal stream break-up transducer and a portion of an array of such transducers, respectively, according to a preferred embodiment of the present invention.
Figure 2B:
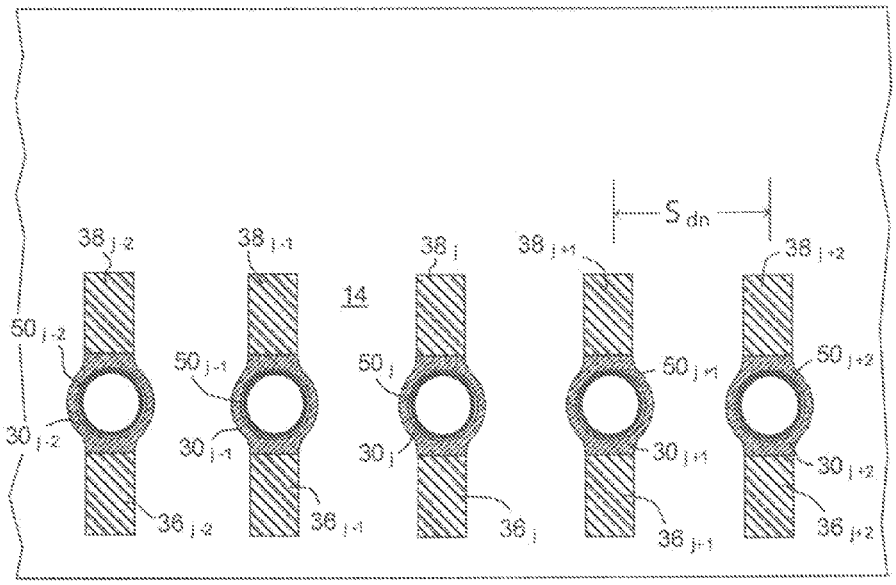

A front face view of a single nozzle 50 of a preferred printhead embodiment is illustrated in FIG. 2*a*. A portion of an array of such nozzles is illustrated in FIG. 2*b*. For simplicity of understanding, when multiple jets and component elements are illustrated, suffixes "j", "j+1", et cetera, are used to denote the same functional elements, in order, along a large array of such elements. FIGS. 2*a* and 2*b* show nozzles 50 of a drop generator portion of printhead 10 having a circular shape with a diameter, $D_{dn}$, equally spaced at drop nozzle spacing, $S_{dn}$, along a nozzle array direction or axis, and formed in a nozzle layer 14. While a circular nozzle is depicted, other shapes for the liquid emission orifice can be used and an effective diameter expressed, for example, the circular diameter that specifies an equivalent open area. Typically the nozzle diameter will be formed in the range of 8 microns to 35 microns, depending on the size of drops that are appropriate for the liquid pattern being deposited. Typically the drop nozzle spacing will be in the range 84 to 21 microns corresponding to a pattern raster resolution in the nozzle axis direction of 300 pixels/inch to 1200 pixels/inch.

An encompassing resistive heater 30 is formed on a front face layer surrounding the nozzle bore. Resistive heater 30 is addressed by electrodes or leads 38 and 36. One of these electrodes 36 can be shared in common with the resistors surrounding other jets. At least one resistor lead 38, however, provides electrical pulses to the jet individually so as to cause the independent stimulation of that jet. Alternatively a matrix addressing arrangement can be employed in which the two address leads 38, 36 are used in conjunction to selectively apply stimulation pulses to a given jet. These same resistive heaters are also utilized to launch a surface wave of the proper wavelength to synchronize the jet of liquid to break-up into drops of substantially uniform diameter, $D_d$, volume, $V_0$, and spacing $\lambda_d$. Pulsing schemes can also be devised that cause the break-up of the stream into segments of fluid that coalesce into drops having volumes, $V_m$, that are approximately integer multiples of $V_0$, i.e. into drops of volume ~$mV_0$, where m is an integer.

Figure 3A:
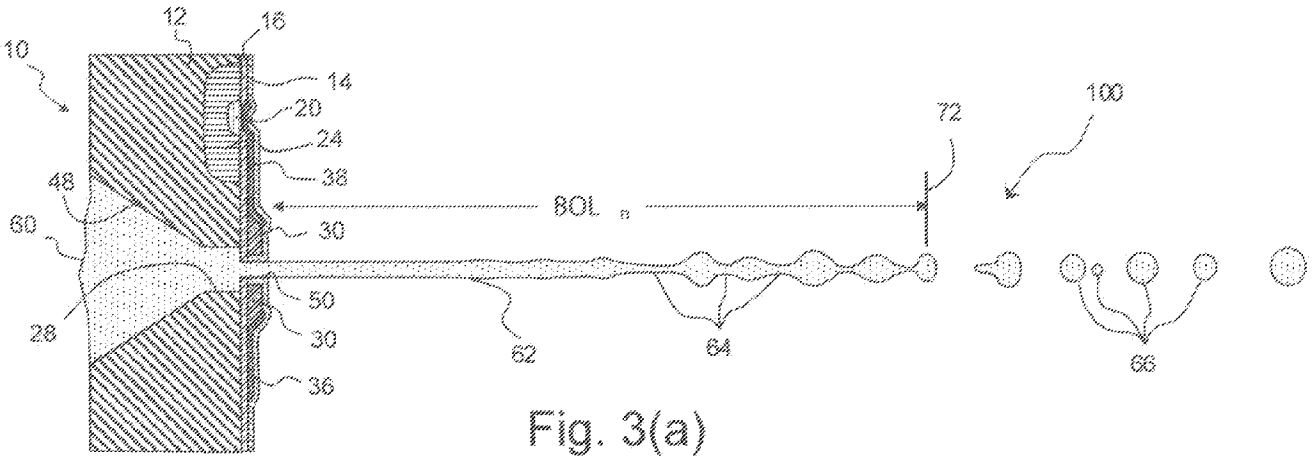
FIGS. 3*a* and 3*b* show schematic cross-sections illustrating natural break-up and synchronized break-up, respectively, of continuous steams of liquid into drops, respectively.
Figure 3B:
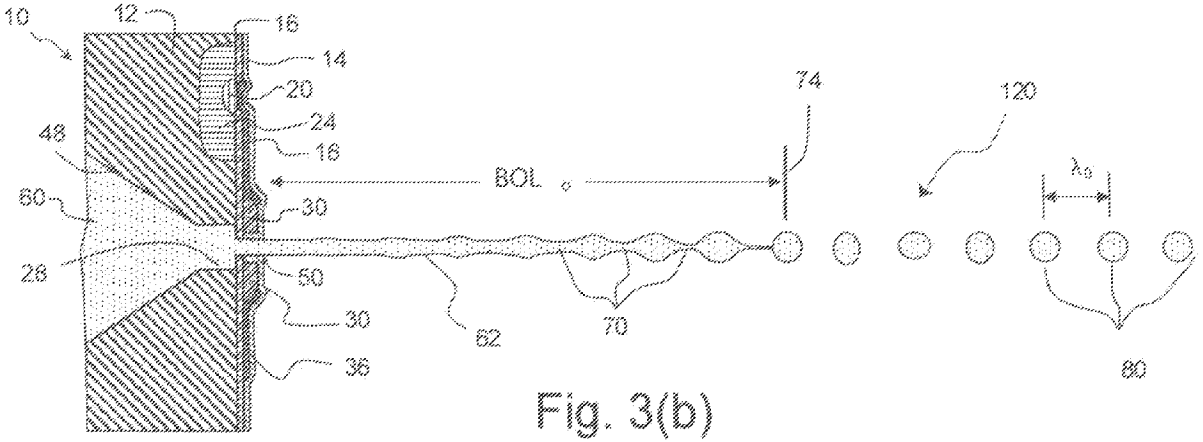

One effect of pulsing nozzle heater 30 on a continuous stream of fluid 62 is illustrated in a side view in FIGS. 3*a* and 3*b*. FIGS. 3*a* and 3*b* illustrate a portion of a drop generator substrate 12 around one nozzle 50 of the plurality of nozzles. Pressurized fluid 60 is supplied to nozzle 50 via proximate liquid supply chamber 48. Nozzle 50 is formed in drop nozzle front face layer 14, and possibly in thermal and electrical isolation layer 16.

In FIG. 3*a*, nozzle heater 30 is not energized. Continuous fluid stream 62 forms natural sinuate surface necking 64 of varying spacing resulting in an unsynchronized break-up at location 77 into a stream 100 of drops 66 of widely varying diameter and volume. The natural break-off length, $BOL_n$, is defined as the distance from the nozzle face to the point where drops detach from the continuous column of fluid. For this case of natural, unsynchronized break-up, the break-off length, $BOL_n$, is not well defined and varies considerably with time.

In FIG. 3*b*, nozzle heater 30 is pulsed with energy pulses sufficient to launch a dominant surface wave causing dominate surface sinuate necking 70 on the fluid column 62, leading to the synchronization of break-up into a stream 120 of drops 80 of substantially uniform diameter, $D_d$, and spacing, $\lambda_0$, and at a stable operating break-off point 76 located an operating distance, $BOL_o$, from the nozzle plane. The fluid streams and individual drops 66 and 80 in FIGS. 3*a* and 3*b* travel along a nominal flight path at a velocity of $V_d$, based on the fluid pressurization magnitude, nozzle geometry and fluid properties.

Figure 4A:
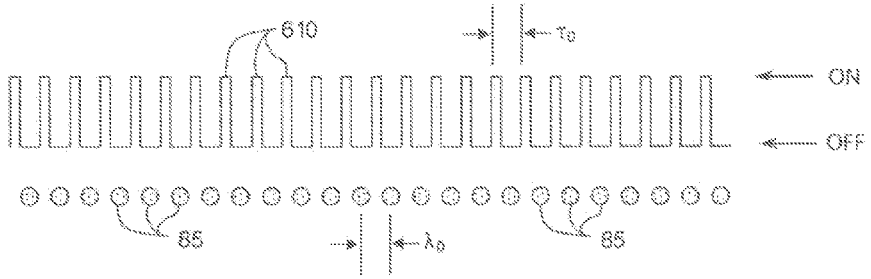
FIGS. 4*a*, 4*b* and 4*c* show representations of energy pulse sequences for stimulating synchronous break-up of a fluid jet by stream break-up heater resistors resulting in drops of different predetermined volumes according to a preferred embodiment of the present inventions.
Figure 4B:
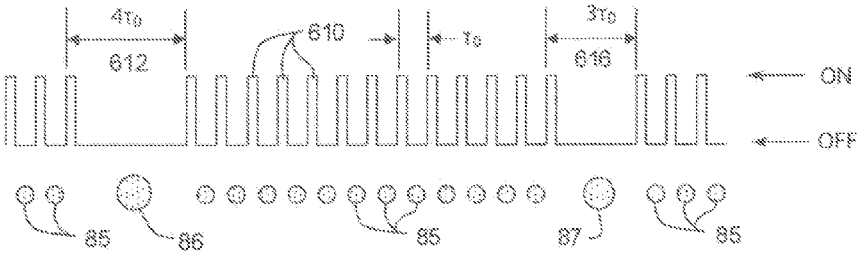
Figure 4C:
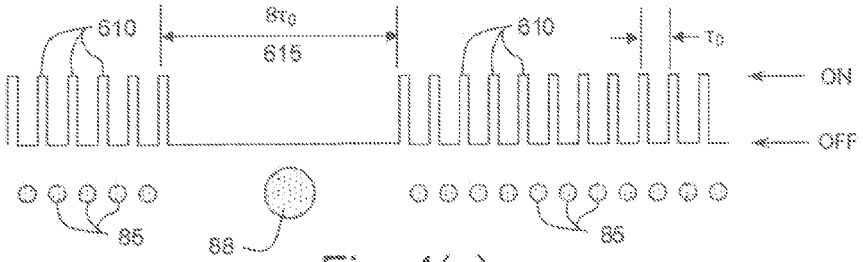

Thermal pulse synchronization of the break-up of continuous liquid jets is also known to provide the capability of generating streams of drops of predetermined volumes wherein some drops can be formed having approximate integer, m, multiple volumes, $mV_0$, of a unit volume, $V_0$. See for example U.S. Pat. No. 6,588,888 to Jeanmaire, et al. and assigned to the assignee of the present inventions. FIGS. 4*a*-4*c* illustrate thermal stimulation of a continuous stream by several different sequences of electrical energy pulses. The energy pulse sequences are represented schematically as turning a heater resistor "on" and "off" to create a stimulation energy pulse during unit periods, $\tau_0$.

In FIG. 4*a*, the stimulation pulse sequence consists of a train of unit period pulses 610. A continuous jet stream stimulated by this pulse train is caused to break up into drops 85 all of volume $V_0$, spaced in time by $\tau_0$ and spaced along their flight path by $\lambda_0$. The energy pulse train illustrated in FIG. 4*b* consists of unit period pulses 610 plus the deletion of some pulses creating a $4\tau_0$ time period for sub-sequence 612 and a $3\tau_0$ time period for sub-sequence 616. The deletion of stimulation pulses causes the fluid in the jet to collect (coalesce) into drops of volumes consistent with these longer than unit time periods. That is, sub-sequence 612 results in the break-off of a drop 86 having coalesced volume of approximately $4V_0$ and sub-sequence 616 results in a drop 87 of coalesced volume of approximately $3V_0$. FIG. 4*c* illustrates a pulse train having a sub-sequence of period $8\tau_0$ generating a drop 88 of coalesced volume of approximately $8V_0$. Coalescence of the multiple units of fluid into a single drop requires some travel distance and time from the break-off point. The coalesced drop tends to be located near the center of the space that would have been occupied had the fluid been broken into multiple individual drops of nominal volume $V_0$.

The capability of producing drops in substantially multiple units of the unit volume $V_0$ can be used to advantage in differentiating between print and non-printing drops. Drops can be deflected by entraining them in a cross air flow field. Larger drops have a smaller drag to mass ratio and so are deflected less than smaller volume drops in an air flow field. Thus an air deflection zone can be used to disperse drops of different volumes to different flight paths. A liquid pattern deposition system can be configured to print with large volume drops and to gutter small drops, or vice versa.

Figure 5:
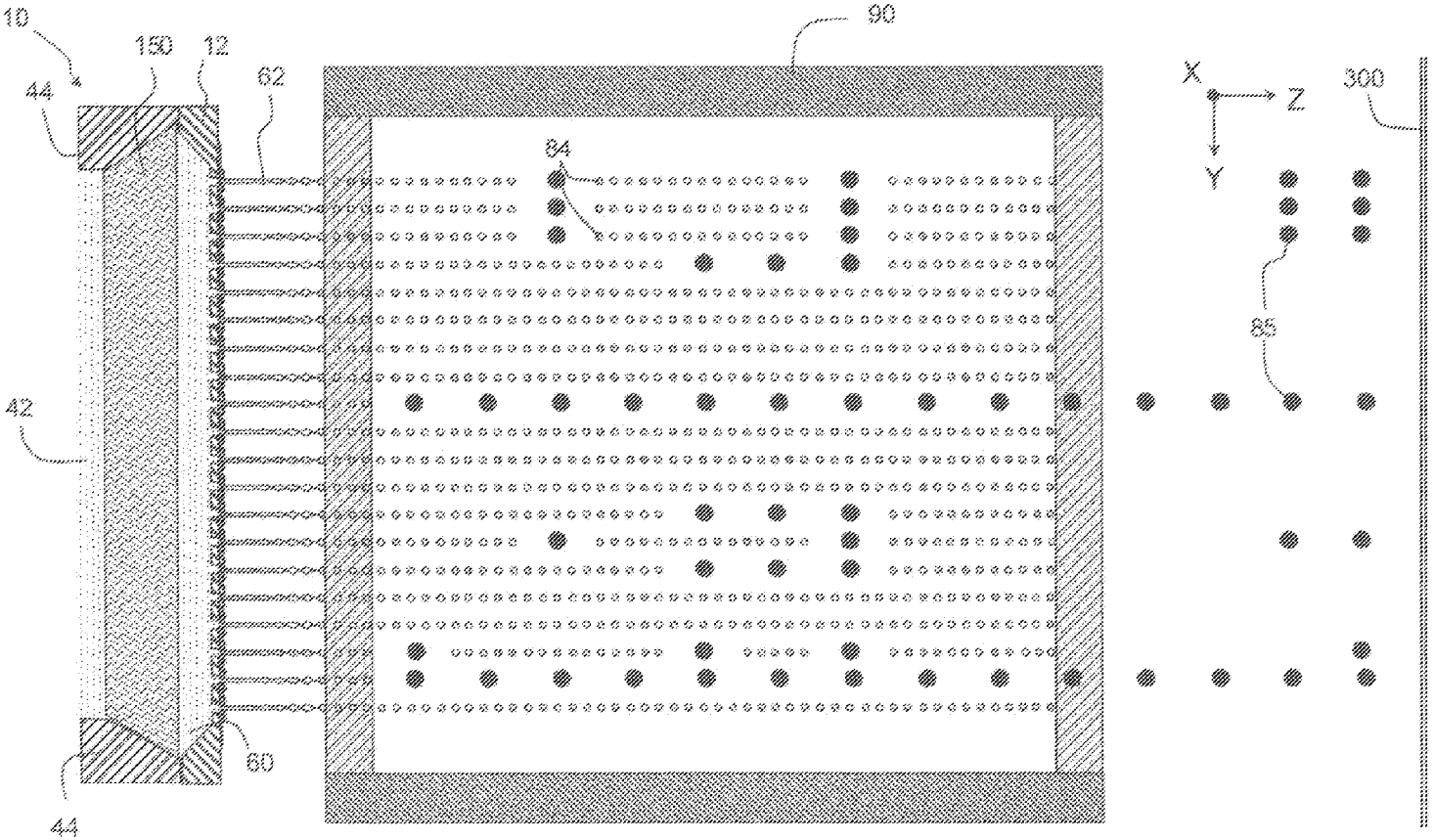
FIG. 5 shows a cross-sectional view of a liquid drop emitter operating with large and small drops according to print data.

FIG. 5 illustrates in plan cross-sectional view a liquid drop pattern deposition system configured to print with large volume drops 85 and to gutter small volume drops 84 that are subject to deflection airflow in the X-direction, set up by airflow plenum 90. A multiple jet array printhead 10 is comprised of a semiconductor substrate 12, also called a nozzle plate 148, formed with a plurality of jets and jet stimulation transducers attached to a common liquid supply chamber component 44. Patterning liquid 60 is supplied via a liquid supply inlet 42, a slit running the length of the array in the example illustration of FIG. 5. The performance of multi-jet drop generator 10 will be discussed below for configurations with and without the incorporation of an acoustic damping structure formed in the semiconductor substrate 12 in order to explain the present inventions. Note that the large drops 85 in FIG. 5 are shown as "coalesced" throughout, whereas in actual practice, the fluid forming the large drops 85 often will not coalesce until some distance from the fluid stream break-off point.

Figure 6:
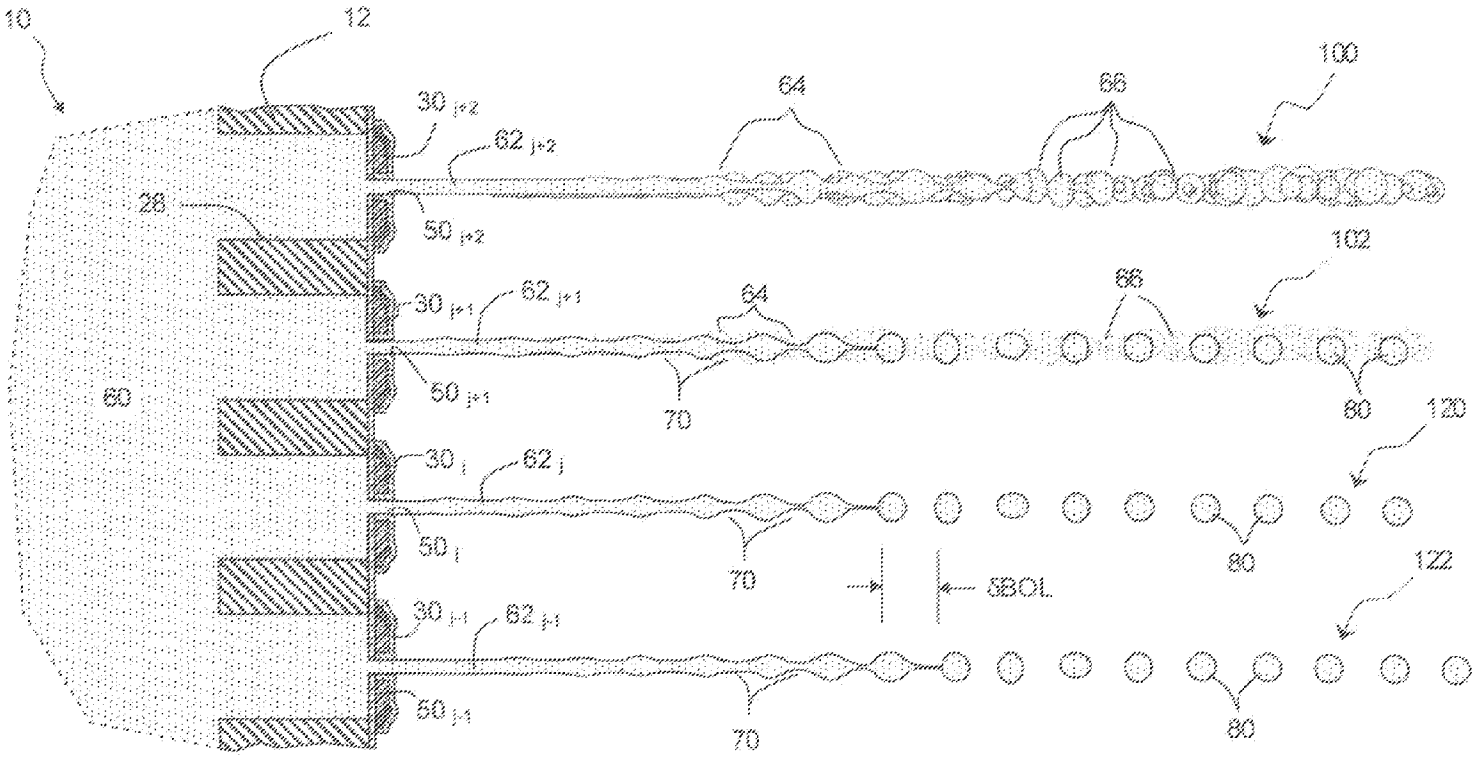
FIG. 6 shows a cross-sectional view of a portion of an array of continuous drop emitters illustrating the affect of stimulation crosstalk among nearby jets.
Figure 7:
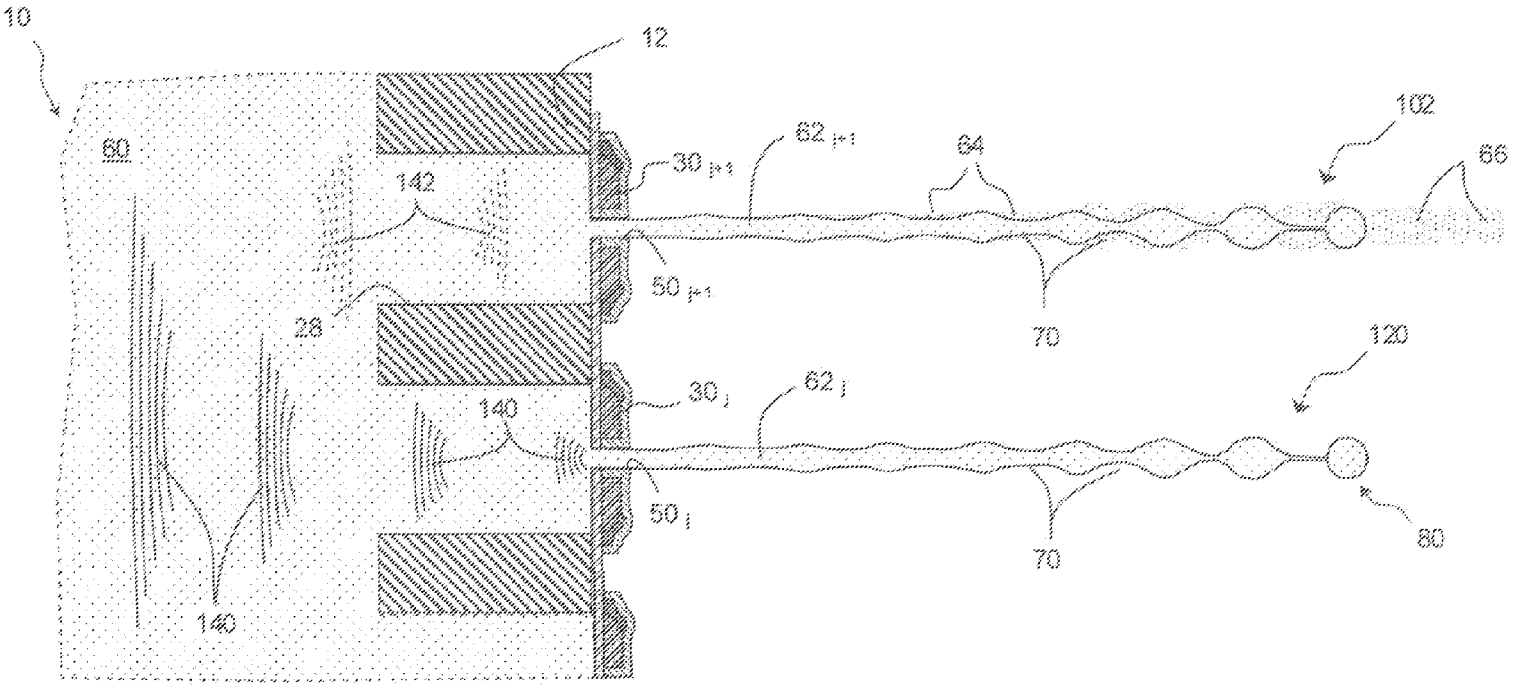
FIG. 7 shows a cross-sectional view of two jets of an array of continuous drop emitters illustrating acoustic crosstalk from jet stimulation.

FIG. 6 illustrates in plan cross-sectional view a portion of a prior art multi jet array including nozzles, streams and heater resistors associated with the $j^{th}$ jet and neighboring jets j+1, j+2 and j−1 along the array (arranged along the Y-direction in FIG. 5). The fluid flow to individual nozzles is partitioned by flow separation features 28, in this case formed as bores in drop generator substrate 12. FIG. 7 illustrates an enlarged view of the two central jets of FIG. 6. The printhead 10 of FIGS. 6 and 7 does not have an acoustic damping structure located in the semiconductor substrate 12. Jets $\mathbf{62}_j$ and $\mathbf{62}_{j-1}$ are being actively stimulated at a baseline stimulation frequency, $f_0$, by applying energy pulses to heater resistors $\mathbf{30}_j$ and $\mathbf{30}_{j-1}$ as described with respect to FIG. 4*a*, thereby producing mono-volume drops 80 as was discussed previously.

Jets $\mathbf{62}_{j+1}$ and $\mathbf{62}_{j+2}$ are not being stimulated by energy pulses to corresponding stimulation resistors $\mathbf{30}_{j+1}$ and $\mathbf{30}_{j+2}$. Jet $\mathbf{62}_{j+2}$ is illustrated as breaking up into drops 66 having a natural dispersion of volumes. However, non-stimulated jet $\mathbf{62}_{j+1}$, adjacent stimulated jet $\mathbf{62}_j$, is illustrated as exhibiting a mixture of natural and stimulated jet break-up behavior. The inventors of the present inventions have observed such jet break-up behavior using stroboscopic illumination triggered at a multiple of the fundamental stimulation frequency, $f_0$. When reflected acoustic stimulation energy 142 is present arising as "crosstalk" from the acoustic energy 140 produced at a nearby stimulated jet, the affected stream shows a higher proportion of drops being generated at the base drop volume, $V_0$, and drop separation distance, $\lambda_0$, than is the case for totally natural break-up. The stroboscopically illuminated image of a jet breaking up naturally is a blur of superimposed drops of random volumes. When a small amount of acoustic stimulation energy 142 at the fundamental frequency, $f_0$, is added to the fluid flow, because of source acoustic energy 140 propagated in the common supply liquid channels, the image shows a strong stationary ghost image of a stimulated jet superimposed on the blur of the natural break-up. Acoustic stimulation crosstalk also may give rise to differences in break-off length (δ BOL) among stimulated jets as is also illustrated in FIG. 6 as occurring between jets $\mathbf{62}_j$ and $\mathbf{62}_{j-1}$. Acoustic stimulation crosstalk may adversely affect satellite drop formation.

Figure 8A:
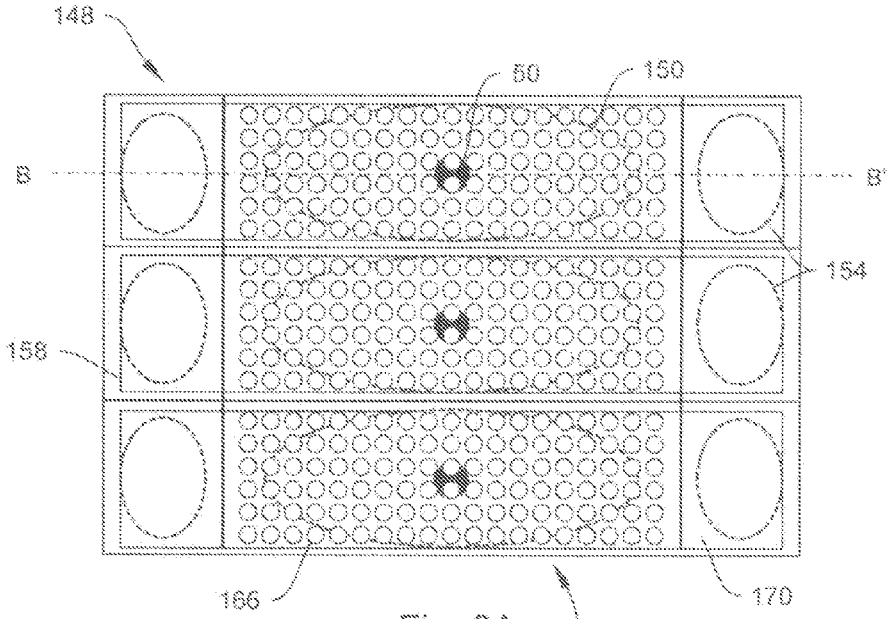
FIGS. 8A and 8B show plan and cross-sectional views of an embodiment of nozzle plate structure having an acoustic damping structure.
Figure 8B:
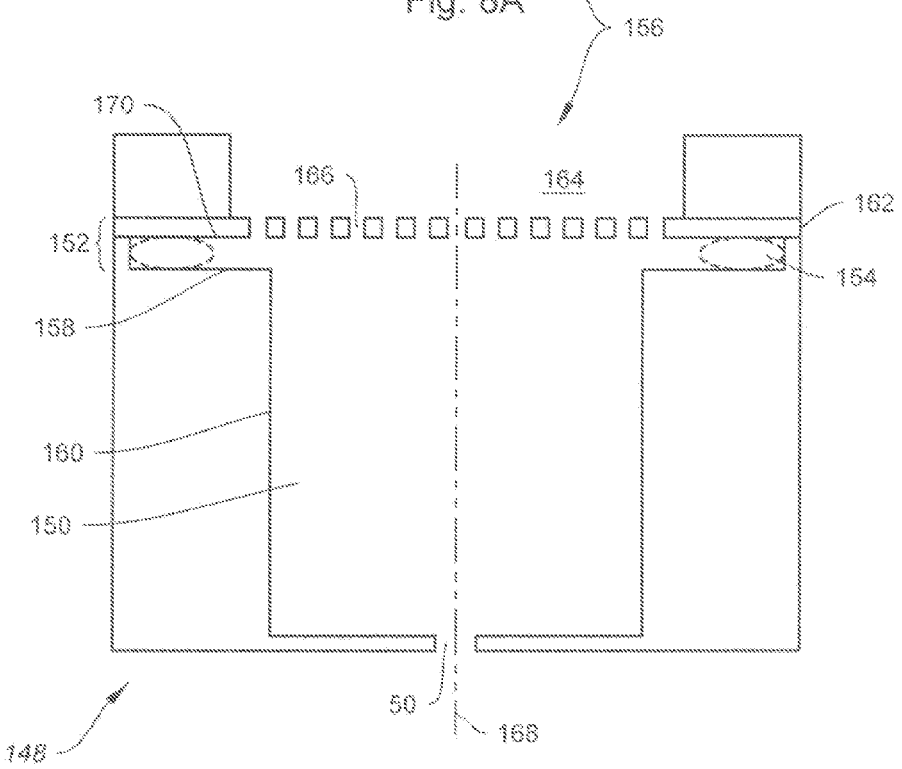

The inventors of the present inventions have realized that acoustic stimulation crosstalk that propagates in the fluid in regions of common fluid supply chambers can be reduced or eliminated by absorbing the sound energy radiated from the nozzle region using an acoustic damping structure. FIG. 8 shows a nozzle plate structure 148 that includes an embodiment of acoustic damping structure; the plan view of a portion of the nozzle plate is shown in FIG. 8A and a cross section view at the cut line B-B is shown in FIG. 8B. The nozzle plate 148 includes a plurality of nozzles 50, typically in a linear array. The nozzle plate 148 also includes a plurality of liquid chambers 150, each of the plurality of liquid chambers being associated with and in fluid communication with a respective one of the plurality of nozzles 50. The nozzle plate 148 also includes an acoustic damping structure 152. The acoustic damping structure 152 provides acoustic, or pressure fluctuation, damping to the liquid in each of the liquid chambers 150. It does so by means of a plurality of sets of air pockets 154 and liquid flow restrictors 156, each of the plurality of liquid chambers being associated with and in fluid communication with one of the sets of air pockets and liquid flow restrictors.

The flow restrictor 156 comprises one or more pores 166 in the restrictor layer 162, through which liquid can enter the liquid chamber 150 from a liquid supply manifold 164. The supply manifold 164 is common to, and in fluid communication with each of the liquid chambers 150 through their associated flow restrictor 156. The size of the pores and the number of pores are selected to provide the desired amount of restriction. The flow of liquid through the one or more pores of the flow restrictor dissipates liquid flow energy in an analogous manner to the dissipation of electrical energy in an electrical resistor. Preferably the one or more pores are symmetrically located about the axis 168 of the nozzle 50 so that the flow of liquid through the pores of the flow restrictor doesn't adversely affect the directionality of the liquid jets flowing out of the nozzles. The restrictor layer 162 can be a silicon based material, a polymeric material, or a metallic material layer in which pores are formed, and which is laminated to the material layer that forms the walls 160 of the liquid chambers 150. The processes for forming pores in each of these restrictor layer materials are well know, and typically include one or more of photolithographic processes, etching processes, and material deposition processes.

The air pocket 154 in the embodiment shown in FIG. 8 forms in a recess 158 formed between a wall 160 of the liquid chamber 150 and the flow restrictor layer 160. In particular the recess is formed between the wall 160 of the liquid chamber and a non-porous portion 170 of the liquid flow restrictor 156. On startup when the printhead is filled with ink or other liquid, a small amount of air gets trapped in the recess 158 to form the air pocket 154 or bubble. As the pressure of the liquid in the printhead is increased the air pocket shrinks in size as the air in the pocket is compressed. The compressibility of the air pocket causes it to act as a small pressure storage device, in an analogous manner to the storage of electrical energy in an electrical capacitor.

The combination of an air pocket and a flow restrictor acts as a low pass filter to pressure fluctuations to damp acoustic waves coming from the nozzles before they arrive at common supply manifold 164. The combination of an air pocket and a flow restrictor also acts as a low pass filter to pressure fluctuations to damp acoustic waves coming from the common supply manifold 164 before they arrive at the nozzles. As a result, crosstalk between nozzles, produced by a coupling of pressure fluctuations or acoustic waves through the liquid from one nozzle to another, is diminished. The amount of acoustic damping depends on the amount of restriction provided by the flow restrictor and by the size of the air pocket. Increasing the amount of flow restriction increases the acoustic damping provided by the acoustic damping structure. However, increasing the flow restriction increases the pressure drop across the flow restrictor, increasing the pressure demands on the liquid supply pump. Increasing the size of the air pocket also increases the amount of acoustic damping.

In a preferred embodiment, the diameter of the pores is selected so that the flow restrictor also serves as a filter, to prevent debris that might affect jet directionality from entering the liquid chamber. When used as a filter, the diameters of the pores of the flow restrictor are preferably less than one fifth the diameter of the nozzle. The liquid flow restrictor includes a porous portion 169 in which the one or more pores are located and a non-porous portion 170.

Figure 9A:
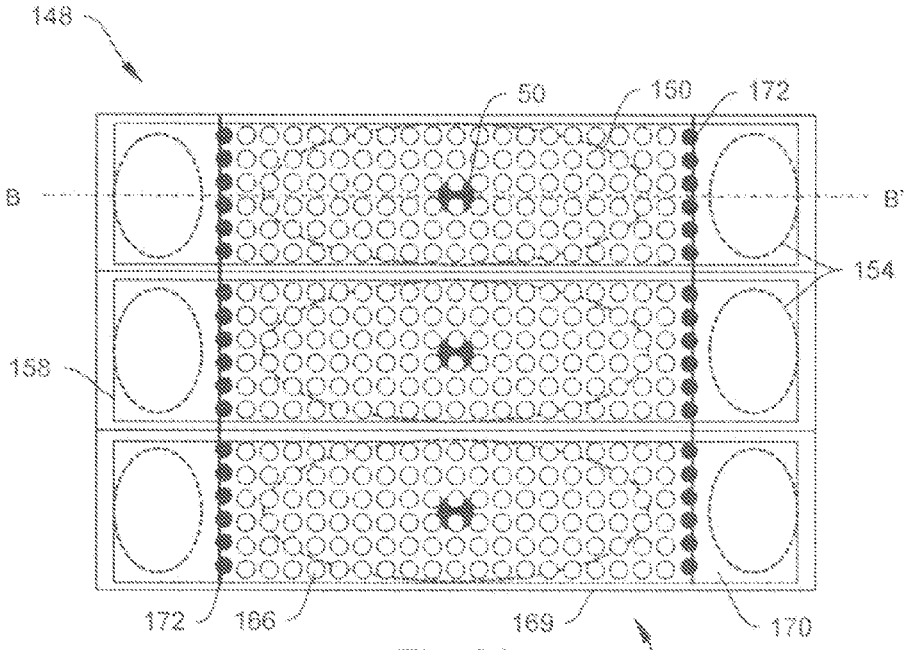
FIGS. 9A and 9B show plan and cross-sectional views of another embodiment of nozzle plate structure having an acoustic damping structure.
Figure 9B:
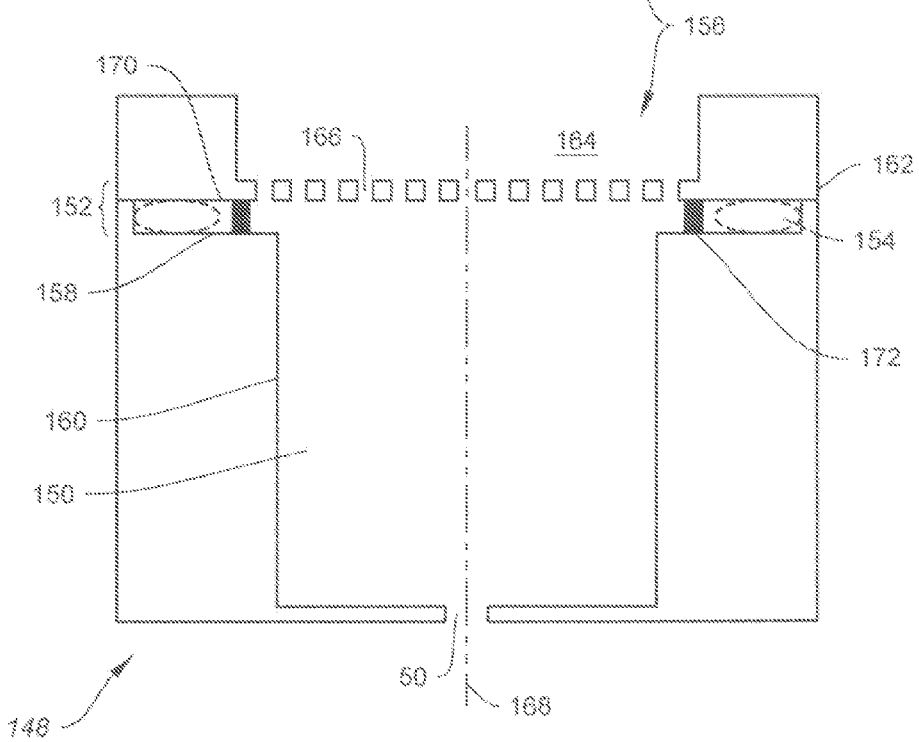

FIG. 9 shows a nozzle plate structure that includes an embodiment of acoustic damping structure; the plan view of a portion of the nozzle plate is shown in FIG. 9A and a cross section view at the cut line B-B is shown in FIG. 9B. The flow restrictor 156 of this embodiment is similar to that of FIG. 8. Again air pockets 154 are formed in a recess between a portion of the wall 160 of the liquid chamber 150 and a non-porous portion 170 of the flow restrictor 156. This embodiment includes post 172 having one end contacting the non-porous portion 170 of the flow restrictor and the other end contacting the wall 160 of the liquid chamber 150 that defines the recess 158 for the air pocket 154. The posts provide some support to the flow restrictor layer, reducing any flexing of the flow restrictor layer. The posts also help to reduce the penetration of liquid into the recess when the printhead is filled with liquid, so that consistent amount of air can be trapped in the air pockets. The posts also add some flow restriction between the liquid chamber and the recesses containing the air pockets, to alter the acoustic damping characteristics of the acoustic damping structure.

Figure 10A:
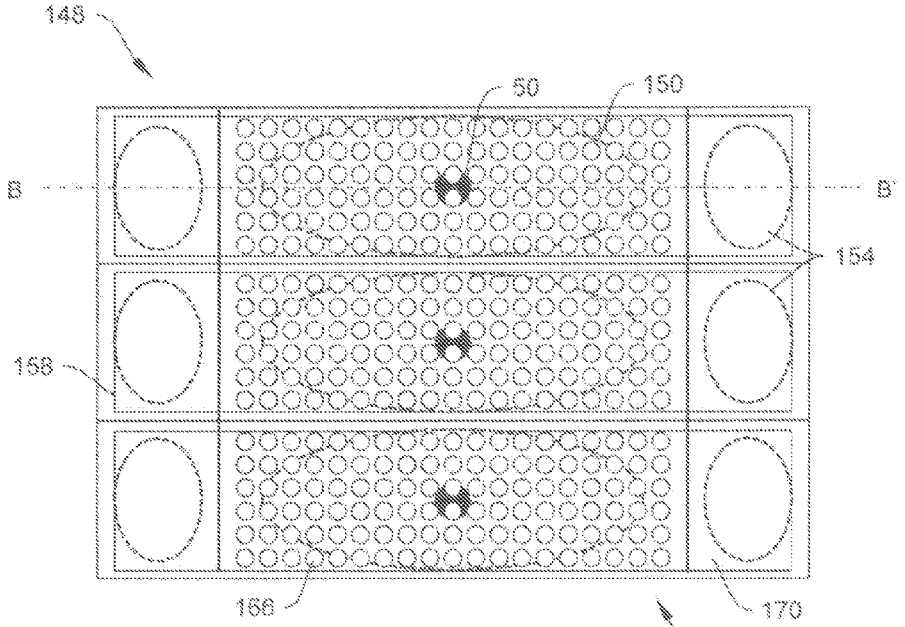
FIGS. 10A and 10B show plan and cross-sectional views of another embodiment of nozzle plate structure having an acoustic damping structure.
Figure 10B:
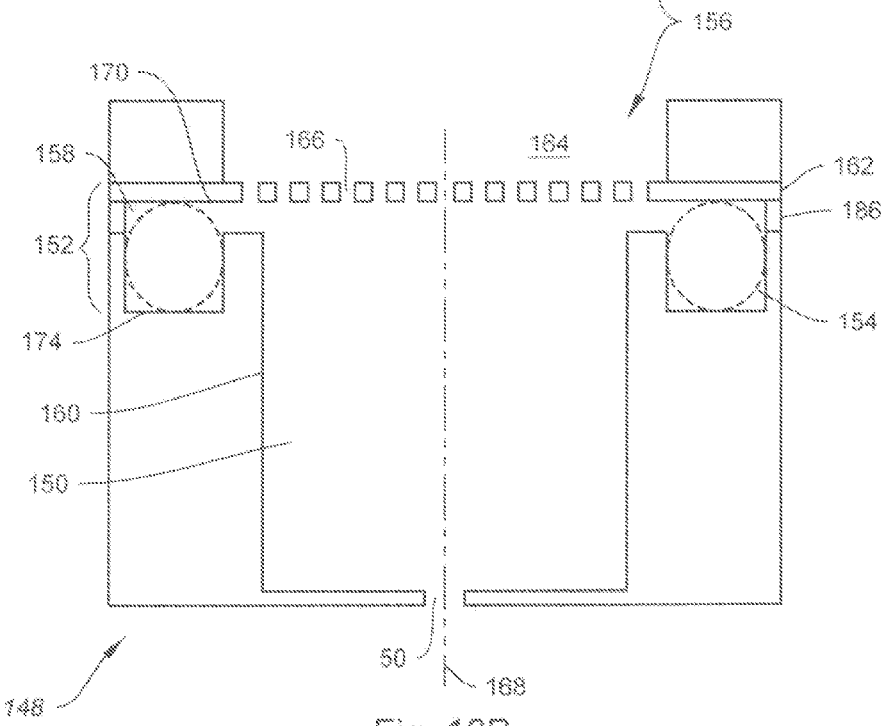

FIG. 10 shows another embodiment of the invention. One or more cavities 174 are formed in the in the wall 160 of each of the liquid chamber 150. The cavities 174 in the wall 160 provide more volume for the formation of the air pockets 154. As the amount of acoustic damping increases with increased air pocket volume relative to the embodiment of FIG. 8 or FIG. 9, this embodiment can provide enhanced levels of acoustic damping relative to the embodiment of FIG. 8. A recess 158 is formed in the interposing layer 186 between the wall 160 of each of the liquid chamber 150 and the restrictor layer 162. The recess 158 provides the fluid communication between cavities 174 and their respective liquid chambers 150.

Figure 11A:
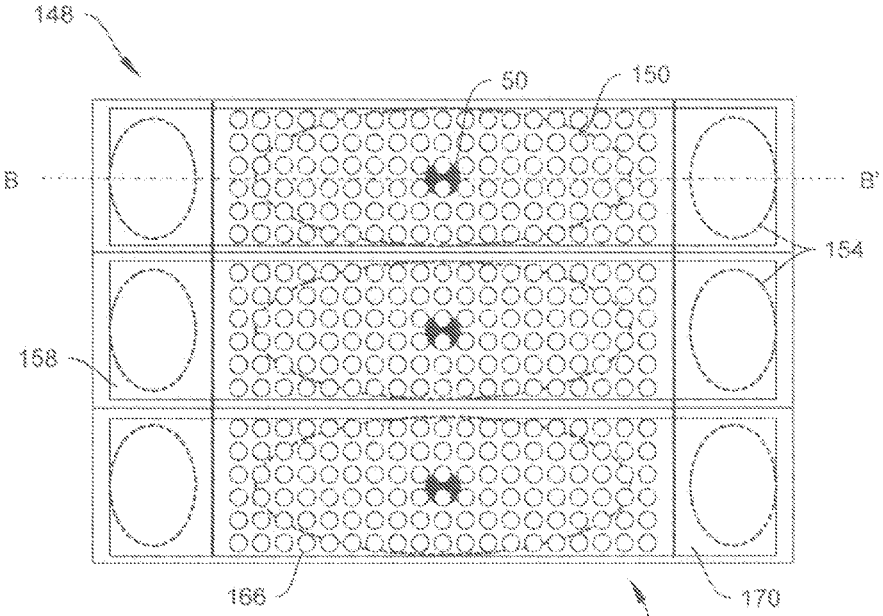
FIGS. 11A and 11B show plan and cross-sectional views of another embodiment of nozzle plate structure having an acoustic damping structure.
Figure 11B:
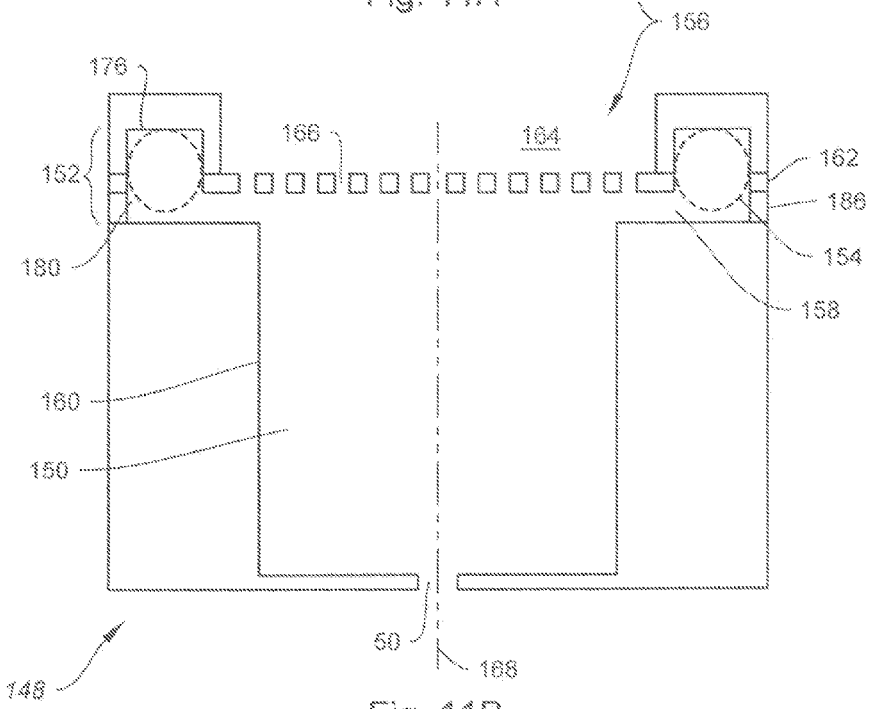

FIG. 11 shows another embodiment in which the acoustic damping structure associated with each liquid chamber 150 includes one or more cavities 176 form in a wall 178 of liquid supply manifold 164. Via 180 through the restrictor layer 162 allow the cavities to be in fluid communication with a recess 158 in the wall 160 of the liquid chamber. Like the cavities 174 of the embodiment in FIG. 10, the cavities of this embodiment provide an increased air pocket volume relative to the embodiment of FIG. 8 or FIG. 9; this embodiment can provide enhanced levels of acoustic damping relative to the embodiment of FIG. 8. For printing systems in which the jetting nozzles 50 aim downward, the orientation of the cavities in this embodiment are less likely to have ink displace air from the cavity when compared to the embodiment of FIG. 10 due to the placement of the cavities above the recess 158 in the wall. It is anticipated that cavities could be formed both in the walls of the liquid chamber, like the cavities 174 of the FIG. 10, and also in the wall of the supply manifold, like the cavities 176 of FIG. 11 to form an even larger volume in which to form an air pocket. It is also anticipated that the posts 172 shown in FIG. 9 could also be used in conjunction with the cavities formed in the walls of liquid chamber or the supply manifold.

In some embodiments, the surfaces of one or more of the recess 158, the cavities 174, and cavities 176 include an anti-wetting coating to enhance the ability of forming a large air pocket in these regions. As air can slowly dissolve into the ink, it is desirable to periodically refresh the air in the air pocket. This can be done by periodically draining the ink from the jetting module, including any ink that may have entered the recess regions and the one or more cavities. The presence of an anti-wetting coating on the surfaces of the recess and the cavities in the walls enhances the ability to remove ink from the air pocket regions. When ink is reintroduced to the jetting module, the placement of the air pockets in corners of the liquid chamber, right downstream of the flow restrictor helps to prevent air from being displaced from the air pocket regions.

In some embodiments, at least a portion of the walls of the cavities 174, cavities 176, recesses 158, and posts, which serve as walls around the air pockets 154 are formed from or coated with a hydrophobic material. The use of such hydrophobic materials on these walls aids in trapping a large amount of air in the air pocket to increase the acoustic damping effectiveness of the acoustic damping structure. If oil based inks are used instead of water based inks, preferably at least a portion of the walls of the cavities 174, cavities 176, recesses 158, and posts, which serve as walls around the air pockets 154 are formed from or coated with a oleophobic material, for the same reason.

FIG. 12 illustrates using a cross section view an embodiment of processes for fabrication the acoustic damping structure on a nozzle plate. FIG. 12A shows a nozzle plate 148 in which an array of nozzles 50 and associated liquid chambers 150 are formed using known processes. If desired, cavities 174 (shown with dashed lines) can be formed in the walls 160 of the liquid chamber 150 using well known photolithographic and etching processes. For clarity in the subsequent process drawings, the cavities are not shown. In FIG. 12B, an interposer layer 186 of polymer film such as TMMF S2045 is laminated to the substrate on the side having the liquid chambers 150. This layer is masked and processed to extend the walls 160 of the liquid chamber 150 except where the recesses 158 are to be formed as shown in FIG. 12C. In embodiments that include posts 172 to bridge from the walls of the liquid chamber to the flow restrictor 156, the posts are also formed in this process. In FIG. 12D, a layer polymer film, such as TMMF S2045 is laminated to the top of the extended walls [interposer layer 186] and to the top of the posts, if present, to form the restrictor layer 162. This layer is masked and processed to form the pores 166 of the flow restrictor 156, as shown in FIG. 12E. If the supply manifold walls are to include cavities 176, via are formed in layer 162 using the same processes used for forming the pores; via 180 denoted by dashed lines. The via are formed in the restrictor layer at locations that will align with the cavities in the supply manifold. In some embodiments, this nozzle plate structure is secured directly to a machined jetting module or printhead body. In other embodiments, a portion of the supply manifold is fabricated in a second wafer using standard etching and photolithographic processes. If cavities 176 are to be formed in the supply manifold walls 178, they are formed using standard processes in a separate step from the formation of the supply manifold 164. The separate step is required as the supply manifold 164 is etched all the way through the wafer while the cavities 176 are not etched completely through the wafer. The supply manifold portion is secured to the nozzle plate 148 having acoustic damping structure 152. FIG. 12D shows the second wafer with the supply manifold walls 178 positioned over the nozzle plate structure 148 prior to securing the supply manifold walls to the nozzle plate structure. In this description of the fabrication process, the process has described the forming of a single nozzle plate with an acoustic damping structure. In general these fabrication steps would be carried out on silicon wafers that include a plurality of nozzle plate die. As such the process steps are carried out to concurrently process each of the nozzle plate die segments rather than on individual die.

In an alternate fabrication process, the recesses 158 are not formed in an interposer layer 186, but rather are formed by etching portions of the top of the walls 160. The restrictor layer 162 is laminated to the non-etched portions of the wall 160. The rest of the fabrication follows the processes outlined above.

Figure 12A:
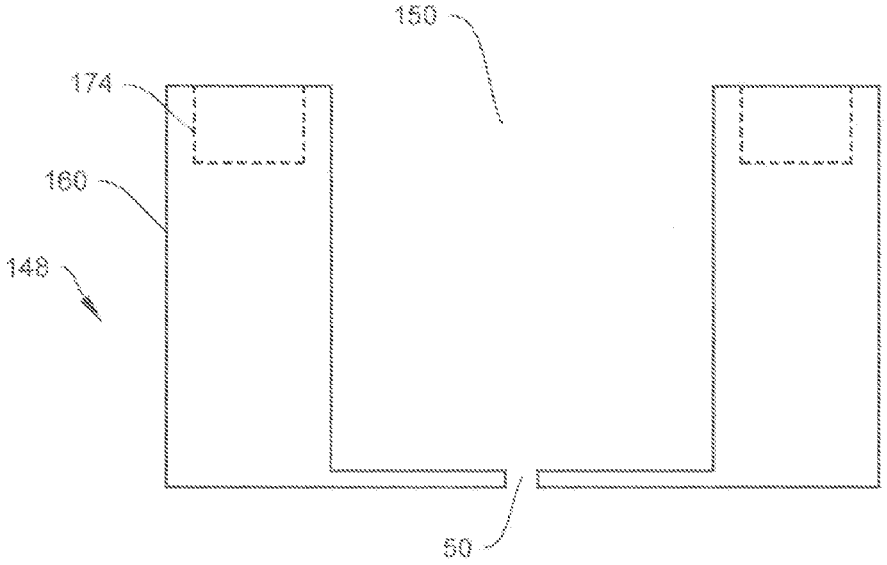
FIGS. 12A-12J illustrate process steps for fabrication of a nozzle plate structure having an acoustic damping structure.
Figure 12B:
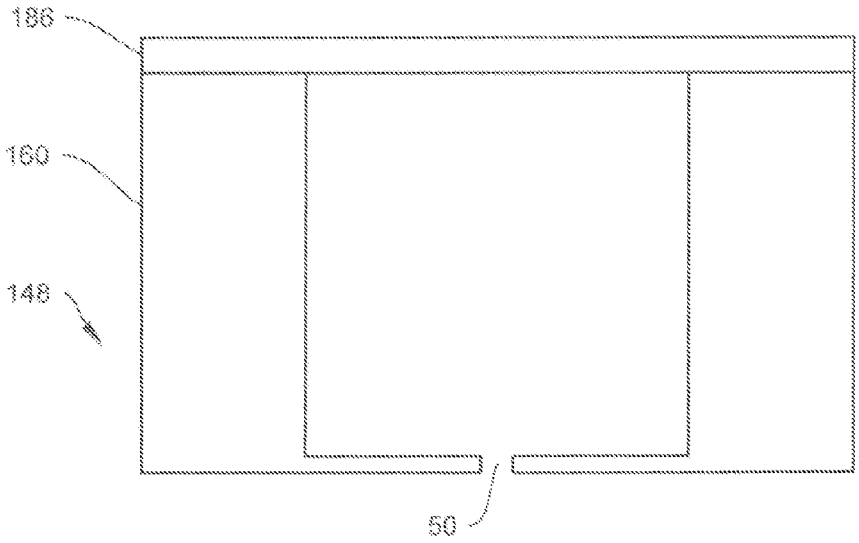
Figure 12C:
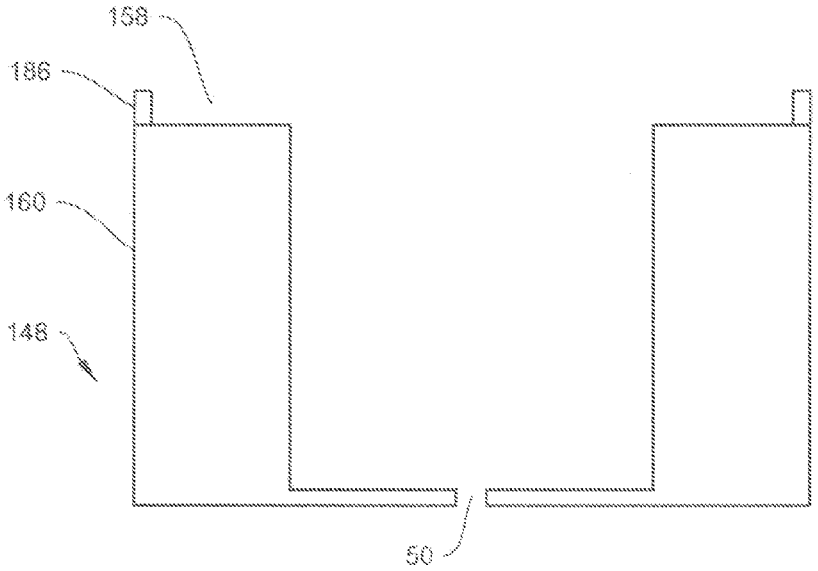
Figure 12D:
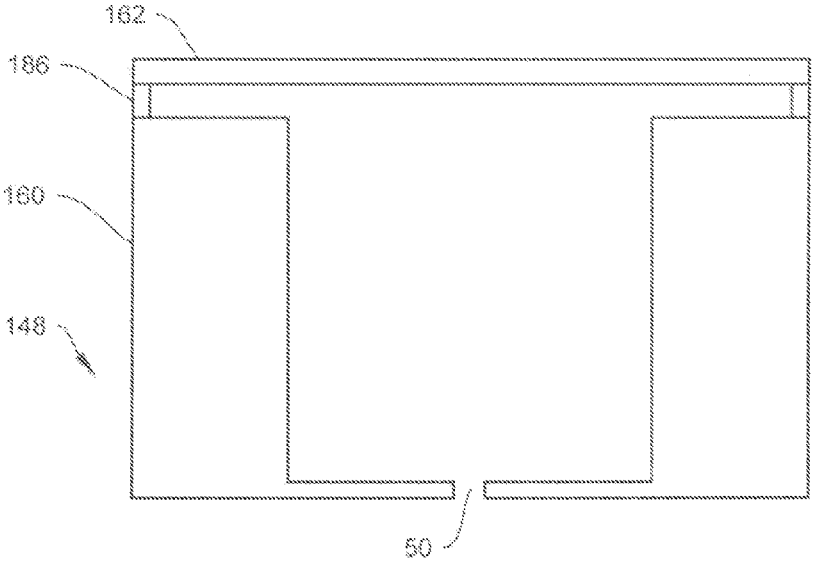
Figure 12E:
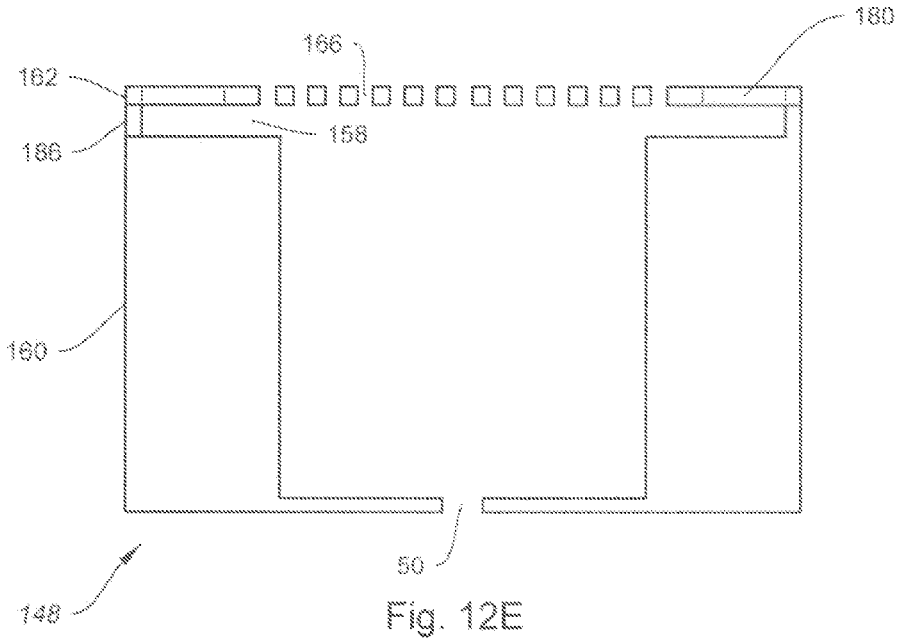
Figure 12F:
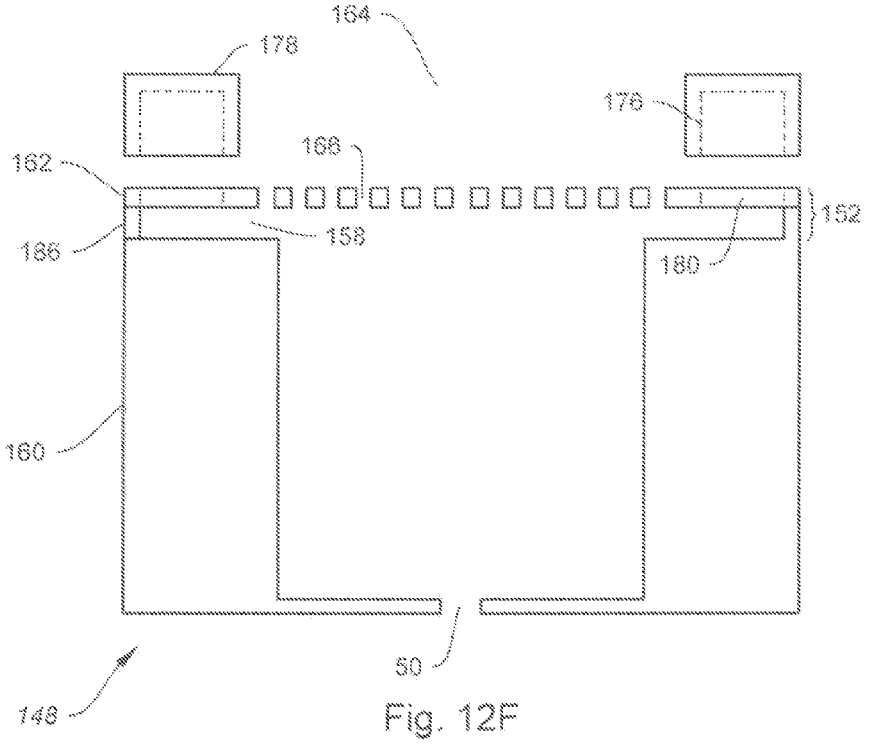
Figure 12G:
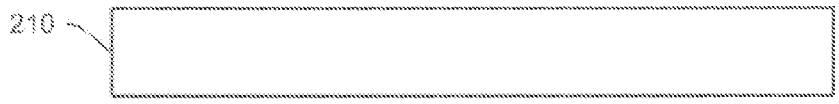
Figure 12H:
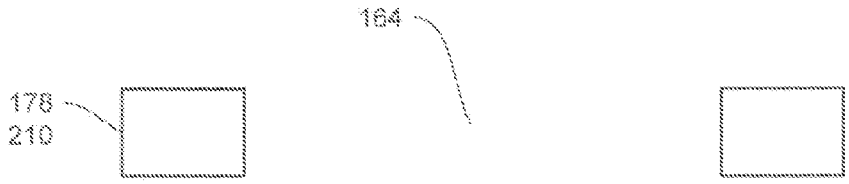
Figure 12I:
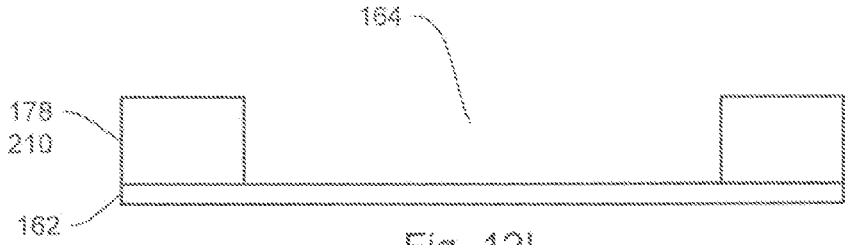
Figure 12J:
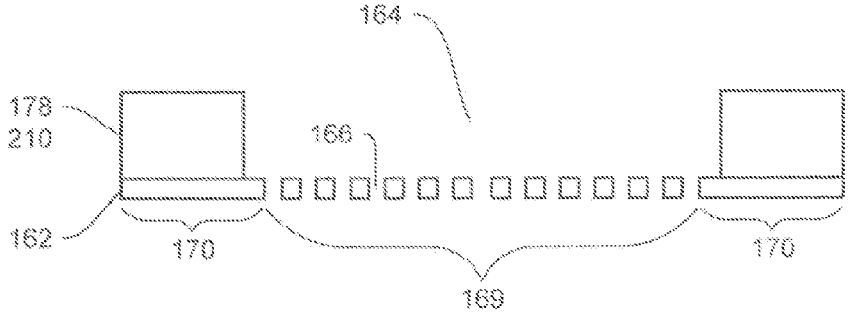

In another alternate fabrication process, the restrictor layer 162 is laminated to wafer which includes the supply manifold as is shown in FIGS. 12G-12J. The wafer is shown in FIG. 12G. This is patterned and etched to form the supply manifold 164, as shown in FIG. 12H. In FIG. 12I, a layer polymer film, such as TMMF S2045 is laminated to the walls 178 of the supply manifold 164 to form the restrictor layer 162. This layer is masked and processed to form the pores 166 of the flow restrictor 156, as shown in FIG. 12J. This structure can then be secured to the nozzle plate structure 148 shown in FIG. 12C to complete the fabrication.

Figure 13A:
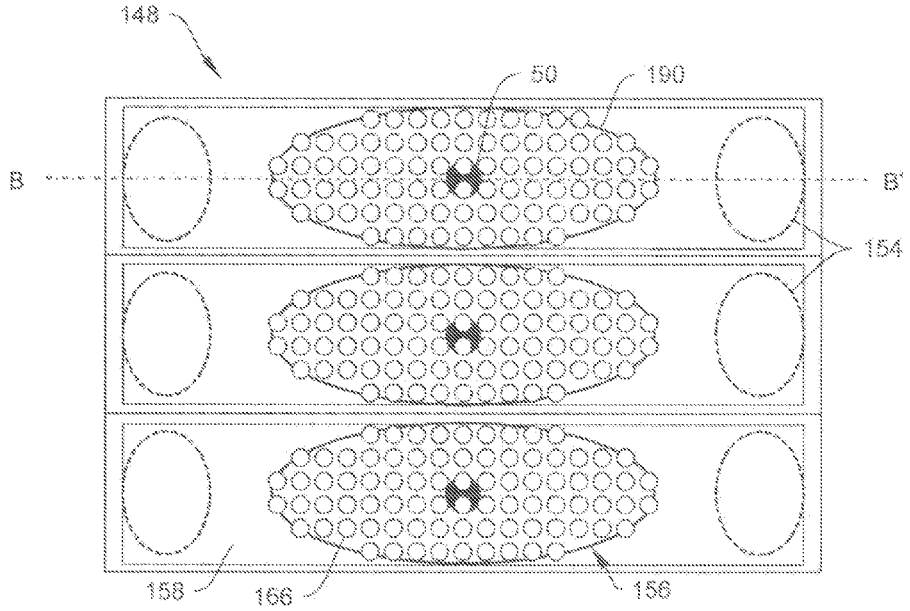
FIGS. 13A and 13B show plan and cross-sectional views of another embodiment of nozzle plate structure having an acoustic damping structure.
Figure 13B:
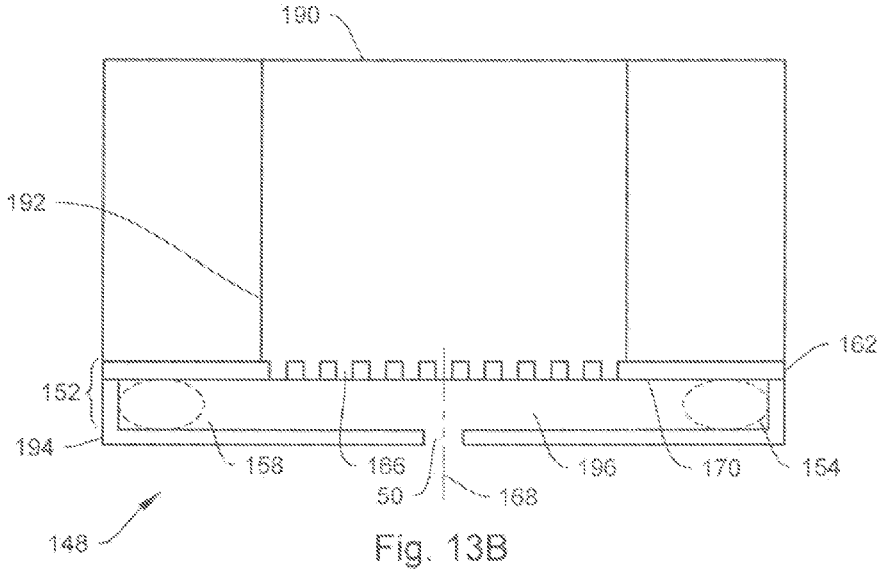

FIG. 13 shows another embodiment of a printhead having a nozzle plate 148 that includes an acoustic damping structure 152. The nozzle plate includes a plurality of nozzles 50, arranged in an array, from which an array of liquid jets can emanate. The nozzle plate also includes a plurality of liquid channels 190, each of the liquid channels being associated with a respective one of the nozzles. The nozzle plate 148 also includes an acoustic damping structure 152. The acoustic damping structure 152 comprises a plurality of sets of air pockets 154 and liquid flow restrictors 156. Each set of air pockets 154 and liquid flow restrictors 156 being associated with a respective one of the nozzles 50. Each set of air pockets 154 and liquid flow restrictors 156 includes one or more air pockets 154. The liquid flow restrictor 156 includes one or more pores through a flow restrictor material layer 162. The flow restrictors 156 of acoustic damping structure 152 are positioned between the liquid channel 190 and the nozzle 50 such that each of the liquid channels 190 is in fluid communication with a respective one of the nozzles through the flow restrictor 156 of the respective one of the sets of air pockets 154 and flow restrictors 156. The flow restrictors comprise one or more pores 160 through the flow restrictor layer 162. Preferably the one or more pores of the flow restrictor 156 are symmetrically placed about the axis 168 of the nozzle to minimize the potential of jet directionality shifts produced by the flow restrictor. In some embodiments, the pores of the flow restrictor are sized to also serve as a filter, to prevent debris that might affect jet directionality from entering the liquid chamber. When used as a filter, the diameters of the pores of the flow restrictor are preferably less than one fifth the diameter of the nozzle.

A liquid chamber 196 is formed between the flow restrictor 156 and the nozzle membrane 194. The liquid chamber 196 helps to stabilize the liquid flow downstream of the pores 166 of the flow restrictor 156 prior to flowing out of the nozzle 50. Air pockets 154 are located in recesses 158 between the non-porous regions of the flow restrictor layer 162 and the nozzle membrane, away from the flow path between the porous region of the restrictor layer 162 and the nozzle 50. As shown, a portion of the wall 192 of the liquid channel 190 is aligned with the recesses 158, so that the recesses 158 are located between a portion of the wall of the liquid channel 190 and the nozzle membrane 194.

As with the previous embodiments, the combination of an air pocket and a flow restrictor acts as a low pass filter to pressure fluctuations to damp acoustic waves coming from the nozzles before they arrive at common supply manifold 164 through the liquid channels 190. The combination of an air pocket and a flow restrictor also acts as a low pass filter to pressure fluctuations to damp acoustic waves coming from the common supply manifold 164, through the liquid channels 190 before they arrive at the nozzles 50. As a result, crosstalk between nozzles, produced by a coupling of pressure fluctuations or acoustic waves through the liquid from one nozzle to another, is diminished. The amount of acoustic damping depends on the amount of restriction provided by the flow restrictor and by the size of the air pocket. Increasing the amount of flow restriction increases the acoustic damping provided by the acoustic damping structure. However, increasing the flow restriction increases the pressure drop across the flow restrictor, increasing the pressure demands on the liquid supply pump. Increasing the size of the air pocket also increases the amount of acoustic damping.

Figure 14A:
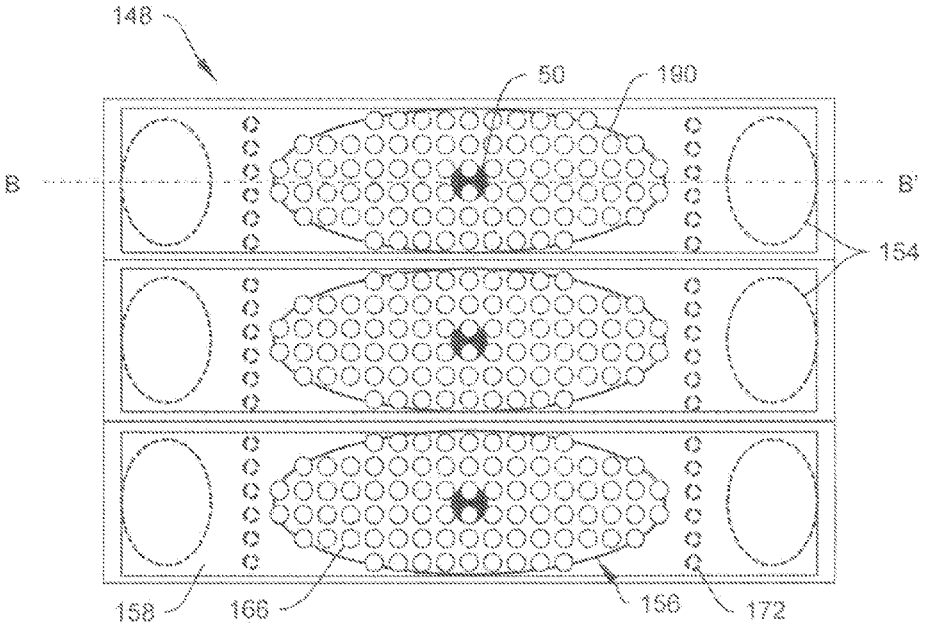
FIGS. 14A and 14B show plan and cross-sectional views of another embodiment of nozzle plate structure having an acoustic damping structure.
Figure 14B:
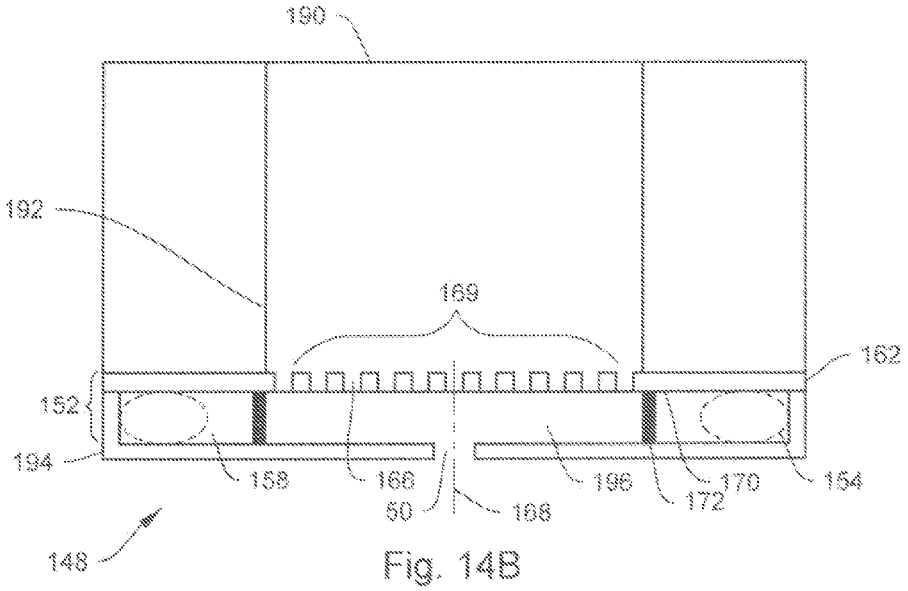

FIG. 14 shows a nozzle plate structure that includes an embodiment of acoustic damping structure; the plan view of a portion of the nozzle plate is shown in FIG. 14A and a cross section view at the cut line B-B is shown in FIG. 14B. The flow restrictor 156 of this embodiment is similar to that of FIG. 13. Air pockets 154 are located in recesses 158 between the non-porous regions of the flow restrictor layer 162 and the nozzle membrane, away from the flow path between the porous region of the restrictor layer 162 and the nozzle 50. As shown, a portion of the wall 192 of the liquid channel 190 is aligned with the recesses 158, so that the recesses 158 are located between a portion of the wall of the liquid channel 190 and the nozzle membrane 194. This embodiment includes post 172 having one end contacting the non-porous portion 170 of the flow restrictor and the other end contacting the nozzle membrane 194. The posts 172 restrict liquid flow between the air pockets 154 and the liquid chamber 196. The posts provide some support to the nozzle membrane 194, reducing any flexing of the nozzle membrane. The posts also help to reduce the penetration of liquid into the recess when the printhead is filled with liquid, so that a consistent amount of air can be trapped in the air pockets. The posts also add some flow restriction between the liquid chamber and the recesses containing the air pockets, to alter the acoustic damping characteristics of the acoustic damping structure.

Figure 15A:
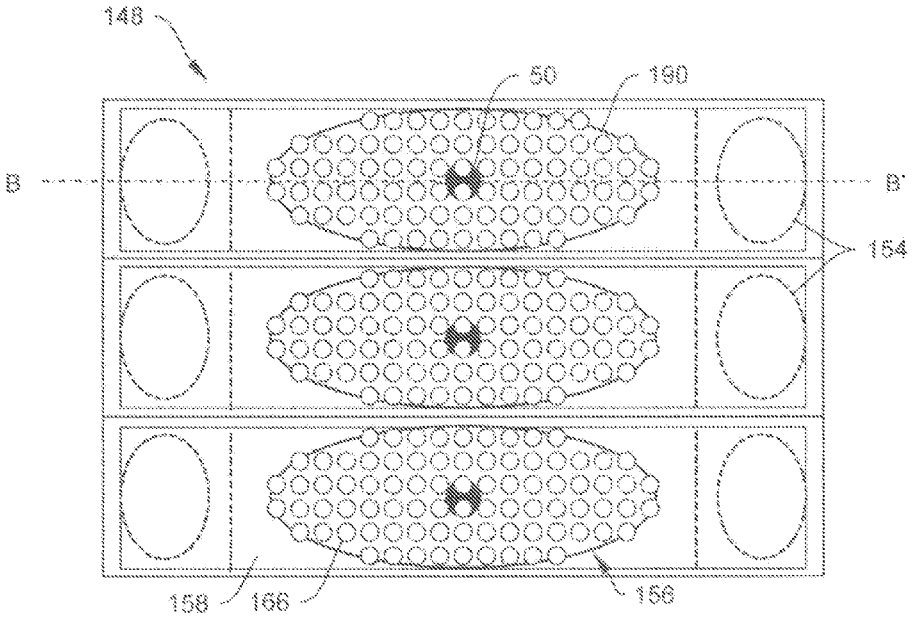
FIGS. 15A and 15B show plan and cross-sectional views of another embodiment of nozzle plate structure having an acoustic damping structure.
Figure 15B:
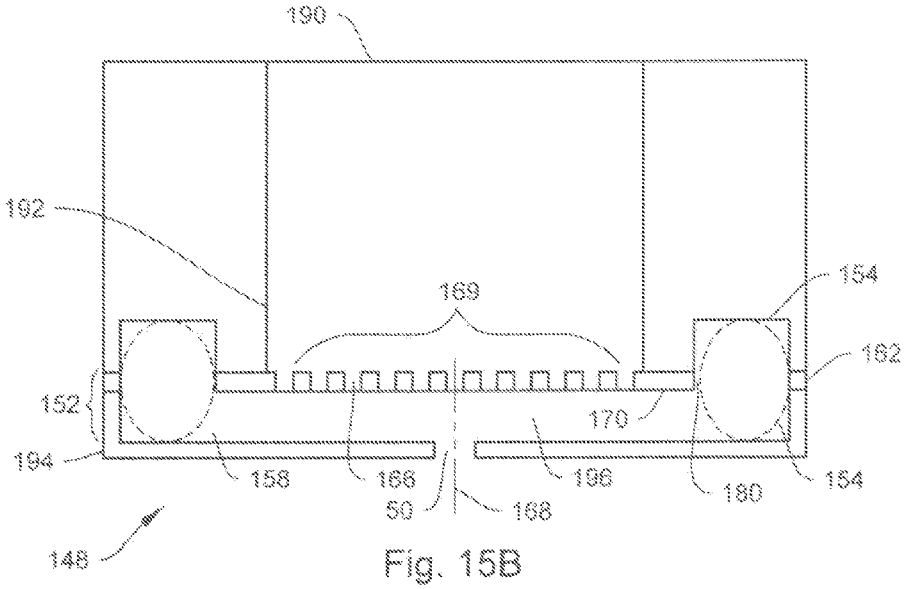
Figure 16A:
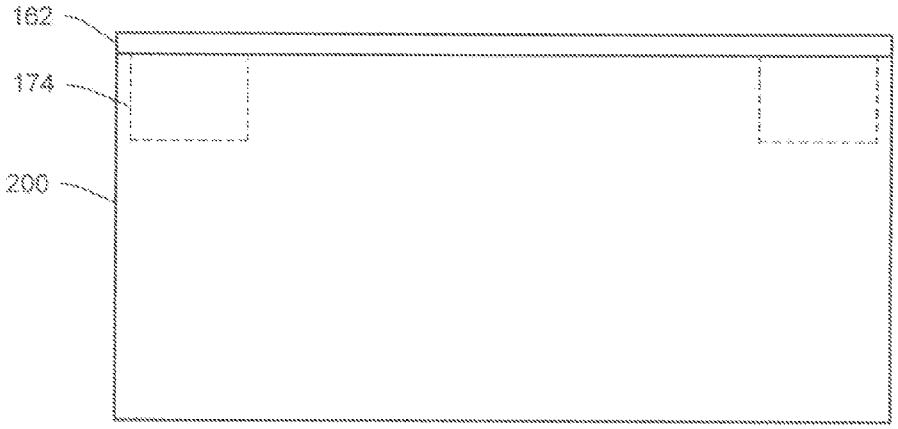
FIGS. 16A-16F illustrate process steps for fabrication of a nozzle plate structure having an acoustic damping structure.
Figure 16B:
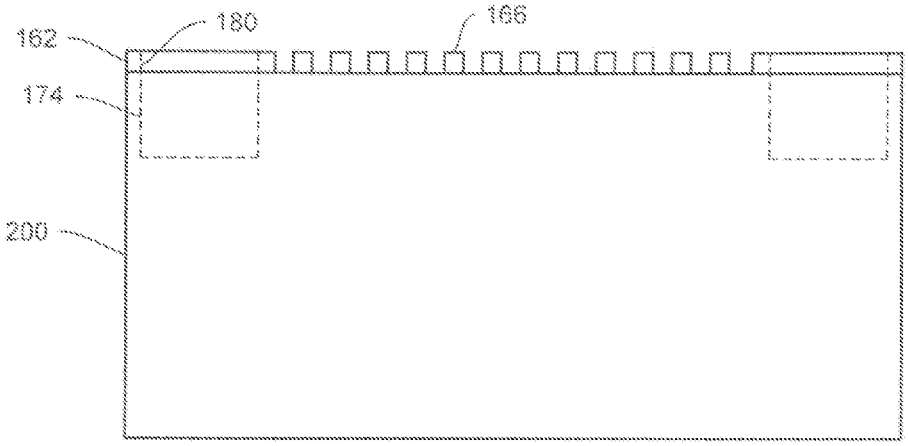
Figure 16C:
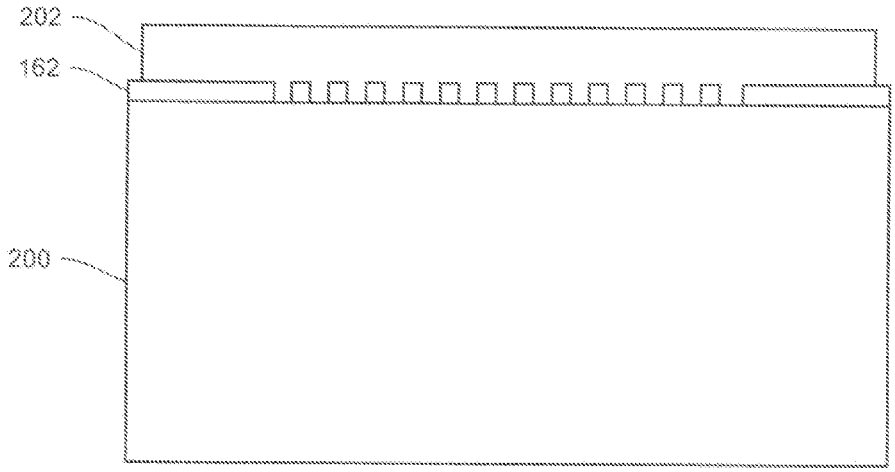
Figure 16D:
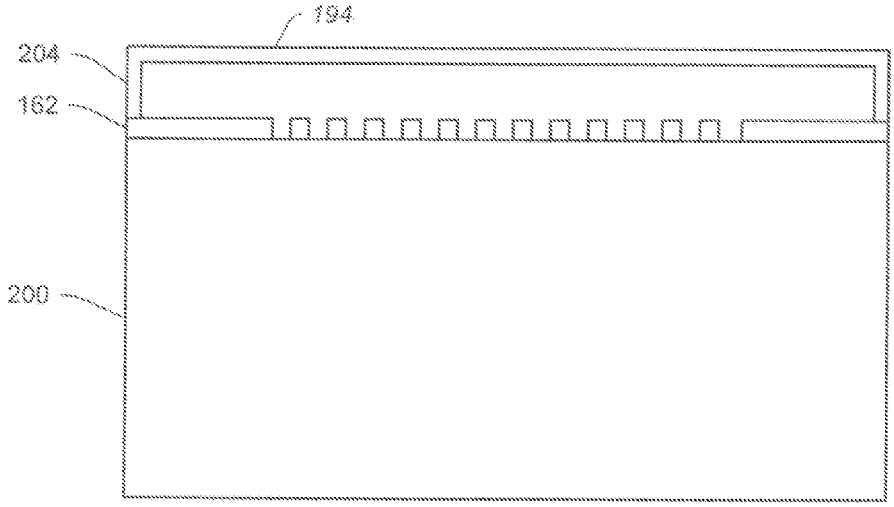
Figure 16E:
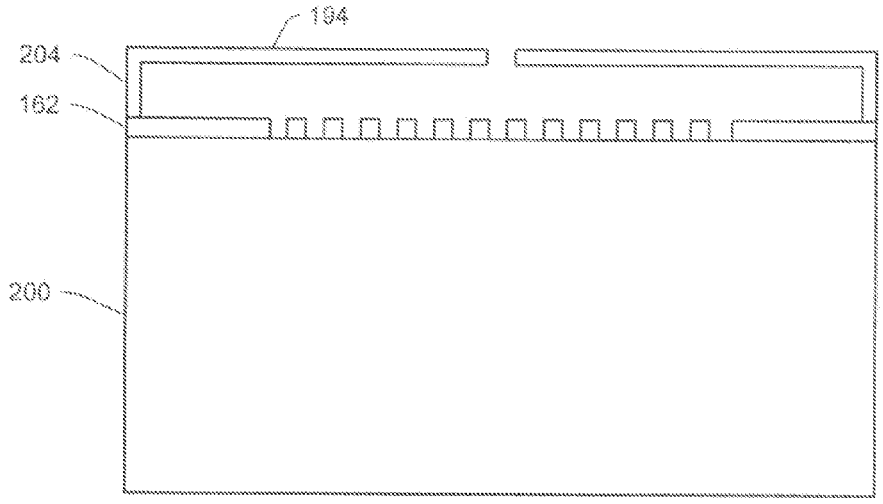
Figure 16F:
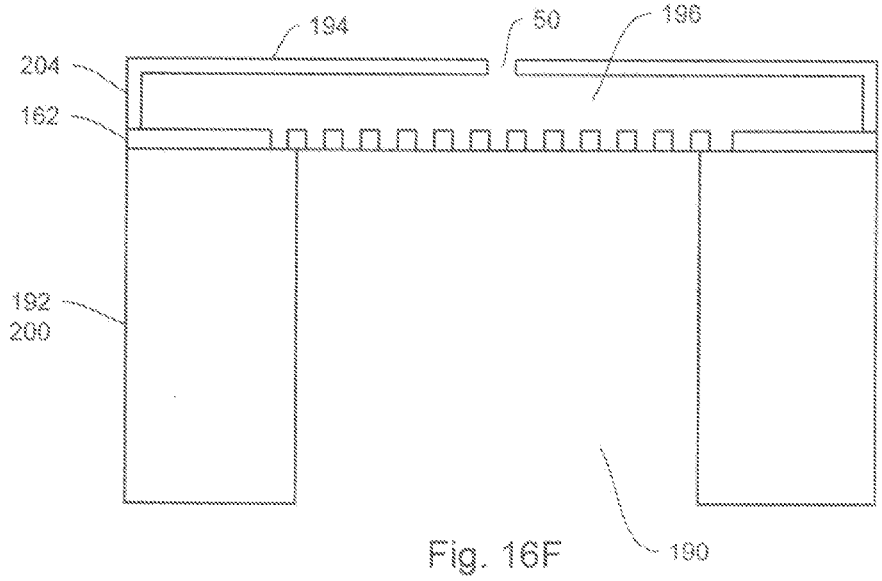

FIG. 15 shows a nozzle plate structure that includes an embodiment of acoustic damping structure; the plan view of a portion of the nozzle plate is shown in FIG. 15A and a cross section view at the cut line B-B is shown in FIG. 15B. This embodiment provides cavities 174 in the walls 192 of the liquid channel 190 to enable the formation of larger air pockets 154. Via 180 through the restrictor layer 162 provide fluid communication between the cavities 174 and the recesses 158 between the nozzle membrane 194 and the restrictor layer 162.

FIG. 16 illustrates using a cross section view an embodiment of processes for fabrication the acoustic damping structure on a nozzle plate. A polymer layer such as TMMF S2045 is laminated as the restrictor layer 162 to the face of the substrate 200, as indicated in FIG. 16A. In embodiments in which cavities 174 are formed in the walls 192 of the liquid channels 190, the cavities 174 are etched into the substrate prior to the lamination of the restrictor layer 162 to the substrate 200; such cavities are denoted by in FIGS. 16A and 16B by dashed lines. As the rest of the processing is unchanged by the presence of the cavities, the cavities are not shown in subsequent figures. The etching of the cavities 174 are by carried out using conventional etching and photolithographic processes. In FIG. 16B, the restrictor layer 162 is patterned to form the pores 166 of the flow restrictor 156. Via 180 are also formed in the same process for embodiments having cavities in the walls 192. In FIG. 16C, a sacrificial material layer 202 is deposited on the restrictor layer 162, and is patterned to define the geometry of the liquid chamber 196. The material to form the walls 204 of the liquid chamber and the nozzle membrane 194 is deposited over the sacrificial material 202 in FIG. 16D. The nozzle is formed in the nozzle membrane in FIG. 16E. The back side of the substrate 200 is patterned and etched to form the liquid channel 190 as shown in FIG. 16F. Finally, the sacrificial material 202 is removed to open up the liquid chamber 196.

The invention has been described in detail with particular reference to certain preferred embodiments thereof, but it will be understood that variations and modifications can be effected within the scope of the invention.

PARTS LIST

10 continuous liquid drop emission printhead
12 drop generator substrate
14 drop nozzle front face layer
16 passivation layer
20 via contact to power transistor
22 printhead electrical connector
24 individual transistor per jet to power heat pulses
28 flow separation feature
30 thermal stimulation heater resistor surrounding nozzle
36 heater lead
38 heater lead
42 pressurized liquid supply inlet
44 Liquid chamber component
48 common liquid supply chamber
50 nozzle
60 pressurized liquid
62 continuous stream of liquid
64 natural sinuate surface necking on the continuous stream of liquid

66 drops of undetermined volume
70 stimulated sinuate surface necking on the continuous stream of liquid
72 natural (unstimulated) break-off length
80 drops of predetermined volume
84 drops of small volume, ~$V_0$, unitary volume drop
85 large volume drops having volume ~5 $V_0$
86 large volume drops having volume ~4 $V_0$
87 large volume drops having volume ~3 $V_0$
88 large volume drops having volume ~8 $V_0$
90 airflow plenum for drop deflection (towards the X-direction)
99 negative pressure source inlet
100 stream of drops of undetermined volume from natural break-up
102 stream of drops of undetermined volume from natural break-up mixed with some drops of pre-determined volume due to acoustic crosstalk
120 stream of drops of pre-determined volume with one level of stimulation
122 stream of drops of pre-determined volume with one level of stimulation
140 sound waves generated in the fluid by jet stimulation
142 reflected or scattered sound waves causing inter-jet stimulation (crosstalk)
148 nozzle plate
150 liquid chamber
152 acoustic damping structure
154 air pocket
156 flow restrictor
158 recess
160 wall
162 restrictor layer
164 supply manifold
166 pore
168 axis of nozzle
169 porous region
170 non-porous region
172 post
174 cavity
176 cavity
178 wall
180 via
182 nozzle layer
184 structure
186 interposer layer
190 liquid channel
192 wall
194 Nozzle membrane
196 liquid chamber
200 substrate
202 sacrificial layer
204 walls
210 wafer
245 connection to liquid recycling unit
250 media transport input drive means
252 media transport output drive means
300 print or deposition plane
400 controller
410 input data source
412 printhead transducer drive circuitry
414 media transport control circuitry
416 liquid recycling subsystem including vacuum source
418 liquid supply reservoir
420 negative pressure source
422 air subsystem control circuitry
424 liquid supply subsystem control circuitry
610 unit period, $\tau_0$, pulses
612 a $4\tau_0$ time period sequence producing drops of volume ~4 $V_0$
615 an $8\tau_0$ time period sequence producing drops of volume ~8 $V_0$
616 a $3\tau_0$ time period sequence producing drops of volume ~3 $V_0$

The invention claimed is:

1. A printhead comprising:
a nozzle plate including a plurality of nozzles;
a plurality of liquid chambers, each liquid chamber being in fluid communication with a respective one of the plurality of nozzles;
an acoustic dampening structure including a plurality of sets of air pockets formed in recesses in walls of the liquid chamber and liquid flow restrictors, each liquid chamber being in fluid communication with one of the sets of air pockets formed in the recesses in the walls of the liquid chamber and liquid flow restrictors, wherein each set of the air pockets in the recesses are in fluid communication with the associated liquid chamber downstream relative to the liquid flow restrictor; and
a common liquid supply manifold in fluid communication with each liquid chamber through the liquid flow restrictor associated with the liquid chamber.

2. The printhead of claim 1, further comprising:
a post positioned between the recess and the liquid chamber that restricts liquid flow between the recess and the liquid chamber.

3. The printhead of claim 1, wherein the liquid flow restrictor includes a porous portion that restricts liquid flow and a non-porous portion that prevents liquid flow.

4. The printhead of claim 3, further comprising:
a post positioned between the recess and the liquid chamber that restricts liquid flow between the recess and the liquid chamber.

5. The printhead of claim 4, wherein one end of the post contacts the non-porous portion of the liquid flow restrictor and another end of the post contacts a wall that defines the recess.

6. The printhead of claim 3, wherein recess location is defined by the non-porous portion of the liquid flow restrictor.

7. The printhead of claim 1, wherein each air pocket extends into a cavity formed in a portion of a wall of the liquid chamber, the cavity being in fluid communication with the liquid chamber via the recess.

8. The printhead of claim 1, wherein each air pocket extends into a cavity formed in a portion of a wall of the common liquid supply manifold, the cavity being in fluid communication with the liquid chamber via the recess.

9. The printhead of claim 1, wherein the liquid flow restrictor is formed from a polymeric material.

10. The printhead of claim 9, wherein the liquid flow restrictor is laminated to a wall that defines the liquid chamber.

11. The printhead of claim 1, wherein the liquid flow restrictor includes one or more pores through a flow restrictor material layer.

12. The printhead of claim 11, each liquid chamber of the plurality of liquid chambers being in fluid communication with a distinct portion of the flow restrictor material layer that includes the one or more pores.

13. The printhead of claim 1, further comprising:
a liquid source that provides a liquid under pressure through the liquid flow restrictor, the pressure being sufficient to jet an individual stream of the liquid through each nozzle of the plurality of nozzles after the liquid flows through the liquid flow restrictor.

14. The printhead of claim 1, wherein the recesses include a surface having an anti-wetting coating.

15. A printhead comprising:

a nozzle plate including a plurality of nozzles;

a plurality of liquid chambers, each liquid chamber being in fluid communication with a respective one of the plurality of nozzles;

an acoustic dampening structure including a plurality of sets of air pockets formed in recesses in walls of the liquid chamber and liquid flow restrictors, each liquid chamber being in fluid communication with one of the sets of air pockets formed in the recesses in the walls of the liquid chamber and liquid flow restrictors; and a common liquid supply manifold in fluid communication with each liquid chamber through the liquid flow restrictor associated with the liquid chamber, wherein each air pocket extends into a cavity formed in a portion of a wall of the liquid chamber, the cavity being in fluid communication with the liquid chamber via the recess.

* * * * *